US006511356B2

(12) United States Patent
Yukishima

(10) Patent No.: US 6,511,356 B2
(45) Date of Patent: Jan. 28, 2003

(54) EXHAUST SYSTEM FOR OUTBOARD MOTOR

(75) Inventor: Kenji Yukishima, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/894,911

(22) Filed: Jun. 28, 2001

(65) Prior Publication Data

US 2002/0068491 A1 Jun. 6, 2002

(30) Foreign Application Priority Data

Jun. 28, 2000 (JP) ..... 2000-194308
Dec. 6, 2000 (JP) ..... 2000-370872

(51) Int. Cl.[7] ..... B63H 21/38
(52) U.S. Cl. ..... 440/89; 60/323
(58) Field of Search ..... 440/89; 60/312, 60/313, 314, 321, 323

(56) References Cited

U.S. PATENT DOCUMENTS 3,052,086 A * 9/1962 Kiekhaefer et al.
3,695,238 A * 10/1972 Boerma ..... 60/313
4,022,019 A 5/1977 Garcea
4,312,422 A 1/1982 Matsushita et al.
4,484,440 A 11/1984 Oki et al.
4,787,344 A 11/1988 Okumura et al.
4,951,465 A 8/1990 Torigai
4,965,997 A 10/1990 Suzuki et al.
5,010,731 A 4/1991 Onishi
5,012,648 A 5/1991 Okumura et al.
5,109,668 A 5/1992 Lindstedt
5,251,439 A 10/1993 Nakase et al.
5,306,184 A 4/1994 Nakayama
5,471,835 A 12/1995 Friedman
5,662,073 A 9/1997 Tanaka
5,806,311 A 9/1998 Okamoto
6,055,970 A 5/2000 Takahashi
6,071,159 A 6/2000 Watanabe
6,186,846 B1 2/2001 Takayanagi
6,338,660 B1 * 1/2002 Fukuda ..... 440/89

* cited by examiner

*Primary Examiner*—Sherman Basinger
(74) *Attorney, Agent, or Firm*—Knobbe, Martens, Olson & Bear, LLP.

(57) ABSTRACT

An exhaust system for an outboard motor includes an improved construction that can be compact enough for the limited space afforded within a powerhead of an outboard motor. The outboard motor includes an engine and a support member arranged to support the engine. The engine includes a cylinder block that defines a plurality of cylinder bores. The cylinder bores extend generally horizontally and spaced apart vertically from each other to form a cylinder bank extending generally vertically. At least two exhaust manifolds extend generally vertically aside and along the cylinder bank. Pistons reciprocate within the cylinder bores. A cylinder head closes ends of the cylinder bores to define combustion chambers together with the cylinder bores and the pistons. The cylinder head further defines at least one exhaust port per each one of the combustion chambers. Exhaust passages communicate with the exhaust ports. The exhaust passages are coupled with the exhaust manifolds so that at least one of the exhaust passages is allotted to each one of the exhaust manifolds.

35 Claims, 12 Drawing Sheets

EXHAUST SYSTEM FOR OUTBOARD MOTOR

PRIORITY INFORMATION

This application is based on and claims priority to Japanese Patent Applications No. 2000-194308, filed Jun. 28, 2000, and No. 2000-370872, filed Dec. 6, 2000, the entire contents of which are hereby expressly incorporated by reference.

BACKGROUND OF THE INVENTION

1. Field of the Invention

The present invention generally relates to an exhaust system for an outboard motor, and more particularly relates to an improved exhaust system for an outboard motor that is powered by a multiple cylinder engine.

2. Description of Related Art

A typical outboard motor comprises a power head including an internal combustion engine and a housing unit depending from the power head. Recently, many outboard motors are powered by a multiple cylinder engine because of the better engine performance when compared to a single cylinder engine. The multiple cylinder engines for the outboard motors generally present a number of design obstacles. Some of the design obstacles are problems relating to configurations and arrangements of the exhaust system for the multiple cylinder engine. In outboard motor applications, unlike many other types of vehicle applications, space is very limited. The entire exhaust system for the outboard motor must be confined within the power head and the housing unit.

In some outboard motors, the exhaust system for the outboard motor is formed in substantial part by a cylinder block of the engine. That is, a single exhaust manifold, which communicates with exhaust ports, is formed with the cylinder block and the exhaust gases are delivered downwardly to an exhaust system in the housing unit. Due to the compact nature of the engine, the exhaust manifold is relatively short (compared to engine designs used in other applications, e.g., automotive) and hence the exhaust gases must merge together shortly downstream of the exhaust ports. A problem thus arises because the exhaust gases, coming from different exhaust ports interfere with each other. More specifically, the effect of pulse back from one exhaust port to another occurs. The effect can lessen the engine performance.

U.S. Pat. No. 5,806,311 discloses a solution to the problem. The arrangements for an outboard motor disclosed in this patent include a pair of exhaust manifolds allotted to two groups of cylinders. The cylinders served by the exhaust manifolds are fired so that no two cylinders served by the same exhaust manifold fire consecutively. Although the arrangements are useful for inhibiting the mutual interference of the exhaust gases coming from the different ports, the exhaust manifolds still are bulky and difficult to arrange in the limited space of the outboard motor.

A need therefore exists for an improved exhaust system for an outboard motor that can provide a construction that is compact enough for the space of an outboard motor despite having at least two exhaust manifolds.

It also is well known in four-cycle engine design to have open both the intake valve(s) and exhaust valve(s), which are associated with the same cylinder, for a period of time near Top Dead Center (TDC) as the piston completes the exhaust stroke and begins the intake stroke. The total angular movement of the crankshaft when both inlet and exhaust valves are simultaneously open in the TDC region is know as the overlap period. The reason for this overlap period is to induce as much fresh charge as possible into the cylinder during one combustion cycle (i.e., one four-stroke cycle).

The inlet valve opens toward the end of the exhaust stroke when the outgoing stream of exhaust gases in the exhaust port has sufficient velocity to form a depression in its wake (i.e., behind it in the exhaust port and combustion chamber). As a result, the fresh charge in the induction port will be drawn in the direction of the escaping exhaust gases, so that, in effect, it fills the combustion chamber space as it sweeps out the remaining exhaust gases.

The delay in closing the exhaust valve until after the piston begins the induction stroke also utilizes the partial vacuum created in the exhaust port and surrounding area of the combustion chamber by the exiting exhaust gases. This vacuum draws fresh charge into the combustion chamber as the inlet valve continues to open and the piston itself has not yet created a large vacuum pump effect.

Tuning the length of the exhaust pipe communicating with the exhaust port can increase the vacuum effect created during the overlap period. The length of the exhaust pipe will influence the timing of a pressure wave pulse reflected at the end of the pipe. The pressure-wave pulse desirably is timed so that the first reflected pressure wave reaches the port towards the beginning of the induction and the end of the exhaust period generally at its peak negative amplitude. The negative-pressure wave hitting the exhaust port during the overlap period helps extract (scavenge) the residual exhaust gases from the cylinder and induces the fresh charge to the enter the cylinder. This pulsation wave effect greatly improves air-charging efficiency.

Relatively long exhaust passages are necessary to obtain the pulsation wave effect. However, due to the noted shortage of space, it is difficult to achieve this effect in an outboard motor engine.

Another need thus exists for an improved exhaust system for an outboard motor that can produce the pulsation wave effect despite a limited space at least over some range of engine speeds and loads.

SUMMARY OF THE INVENTION

In accordance with one aspect of the present invention, an outboard motor comprises an internal combustion engine. A support member is arranged to support the engine. The engine includes a cylinder block defining a plurality of cylinder bores. The bores extend generally horizontally and are spaced apart vertically from each other to form a cylinder bank. The cylinder block further defines at least two exhaust manifolds that extend generally vertically along side the cylinder bank. Pistons reciprocate within the cylinder bores, and a cylinder head closes the ends of the cylinder bores to define combustion chambers together with the cylinder bores and the pistons. The cylinder head further defines a plurality of exhaust ports and a plurality of exhaust passages. Each combustion chamber has at least one exhaust port, and each exhaust passage communicates with a respective one of the combustion chambers through at least one of the exhaust ports. The exhaust passages are connected to the exhaust manifolds so that at least one of the exhaust passages is allotted to each one of the exhaust manifolds.

In accordance with another aspect of the present invention, an outboard motor comprises an internal combustion engine. A support member is arranged to support the engine. The engine includes a cylinder block, which defines a plurality of cylinder bores, and at least two exhaust manifolds. Pistons reciprocate within the cylinder bores, and a cylinder head closes the ends of the cylinder bores to define combustion chambers together with the cylinder bores and the pistons. The cylinder head further defines a plurality of exhaust ports and a plurality of exhaust passages. Each combustion chamber has at least one exhaust port, and each exhaust passage communicates with a respective one of the combustion chambers through at least one of the exhaust ports. The exhaust passages communicate with the exhaust manifolds so that at least one of the exhaust passages is connected to each exhaust manifold. At least one of the exhaust manifolds includes a downpipe section and a detour section that lies between one of the exhaust passages and the downpipe section.

In accordance with a further aspect of the present invention, an outboard motor comprises an internal combustion engine. A support member is arranged to support the engine. The engine includes a cylinder block defining a plurality of cylinder bores. The cylinder bores extend generally horizontally and are spaced apart from each other to form a cylinder bank. The cylinder block further defines at least two exhaust manifolds. Pistons reciprocate within the cylinder bores, and a cylinder head closes the ends of the cylinder bores to define combustion chambers together with the cylinder bores and the pistons. The cylinder head further defines a plurality of exhaust ports and a plurality of exhaust passages. Each combustion chamber has at least one exhaust port, and each exhaust passage communicates with a respective one of the combustion chambers through at least one of the exhaust ports. The exhaust passages are connected to the exhaust manifolds so that at least one of the exhaust passages is allotted to each one of the exhaust manifolds. The exhaust manifolds in turn join together at a location lower than the lower-most cylinder bore.

In accordance with a still further aspect of the present invention, an outboard motor comprises an internal combustion engine. A support member is arranged to support the engine. The engine includes a cylinder block defining a plurality of cylinder bores that are disposed in line to form a cylinder bank. The cylinder block further defines at least two exhaust manifolds that extend aside the cylinder bank. Pistons reciprocate within the cylinder bores, and a cylinder head closes the ends of the cylinder bores to define combustion chambers together with the cylinder bores and the pistons. The cylinder head further defines a plurality of exhaust ports and a plurality of exhaust passages. Each combustion chamber has at least one exhaust port, and each exhaust passage communicates with a respective one of the combustion chambers through at least one of the exhaust ports. The exhaust passages communicate with the exhaust manifolds so that at least one of the exhaust passages is connected to each exhaust manifold. A crankshaft is coupled to the pistons and is journaled for rotation about a crankshaft axis. The cylinder bores and the crankshaft are arranged such that a first plane, which contains the crankshaft axis, lies parallel to and offset from a second plane, which contains axes of the cylinder bores. The first plane is offset to a side of the second plane on which the exhaust manifolds are disposed.

In accordance with a yet further aspect of the present invention, an outboard motor comprises an internal combustion engine. A support member is arranged to support the engine. The engine includes a cylinder block defining a plurality of cylinder bores and at least two exhaust manifolds. The cylinder bores and the exhaust manifolds have end openings that face generally in the same direction. Pistons reciprocate within the cylinder bores, and a cylinder head closes the end openings of the cylinder bores to define combustion chambers together with the cylinder bores and the pistons. The cylinder head further defines at least one exhaust port per combustion chambers and exhaust passages that communicate with the exhaust ports. The exhaust passages are coupled with the exhaust manifolds at the end openings of the exhaust manifolds so that at least one of the exhaust passages is allotted to each one of the exhaust manifolds.

BRIEF DESCRIPTION OF THE DRAWINGS

These and other features, aspects and advantages of the present invention will now be described with reference to the drawings of preferred embodiments which are intended to illustrate and not to limit the invention. The drawings comprise 12 figures.

DETAILED DESCRIPTION OF THE PREFERRED EMBODIMENTS OF THE INVENTION

Figure 1:
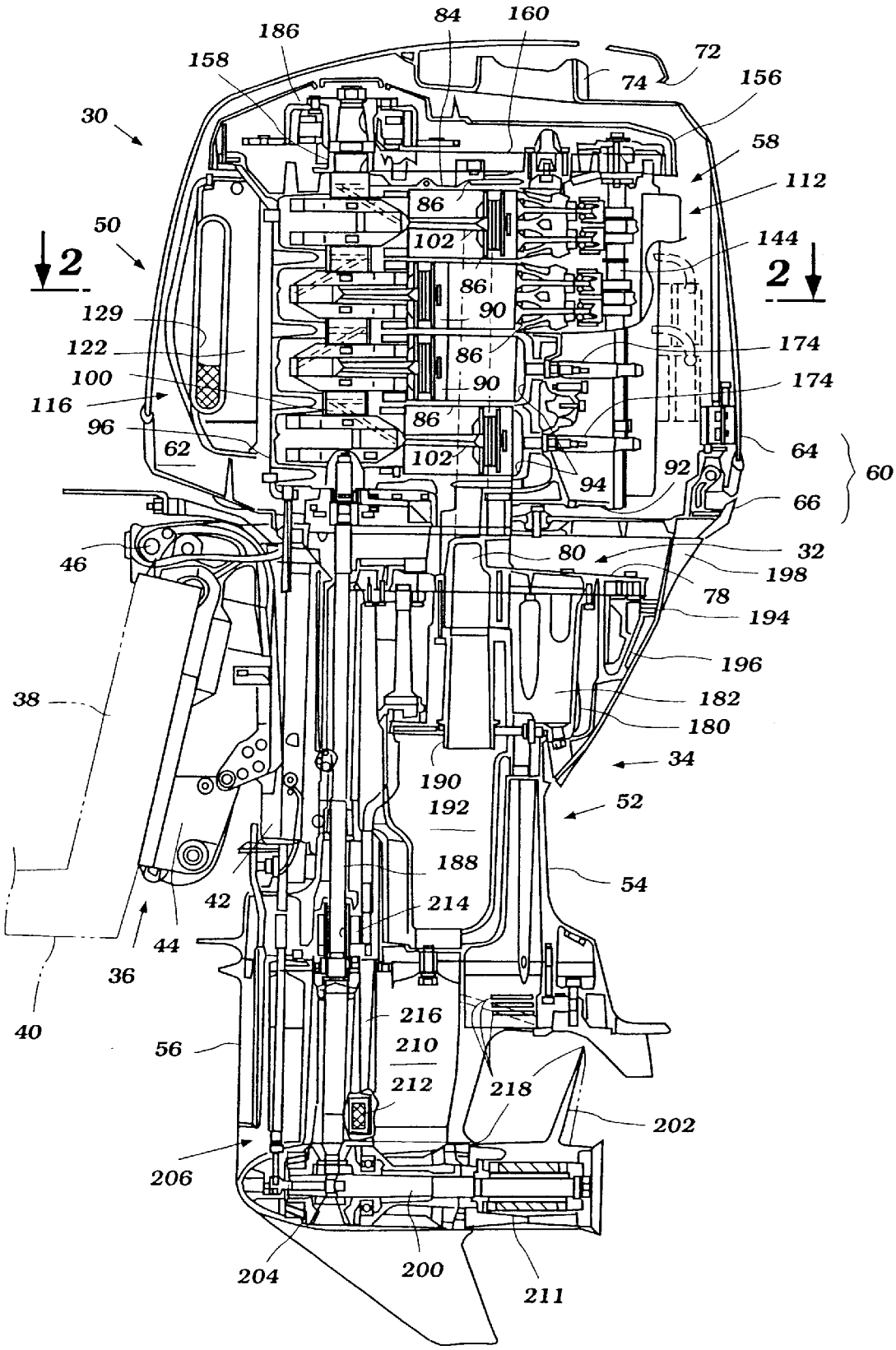
FIG. 1 is a side elevational, sectional view of an outboard motor configured in accordance with a preferred embodiment of the present invention.

With primary reference to FIGS. 1 and 2, and additional reference to FIG. 3, an overall construction of an outboard motor 30, which employs an exhaust system 32 configured in accordance with certain features, aspects and advantages of the present invention, will be described.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 floating on the surface of a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward" and "front" mean at or to the side where the bracket assembly 36 is located, and the terms "rear," "reverse," "backward" and "rearward" mean at or to the opposite side of the front side, unless indicated otherwise or otherwise readily apparent from the context used. In addition, as used in this description, the term "horizontally" means that the subject portions, members or components extend generally parallel to the water line where the associated watercraft is resting when the drive unit 34 is not tilted and is placed in the position shown in FIG. 1. The term "vertically" in turn means that portions, members or components extend generally normal to those that extend horizontally.

A hydraulic tilt and trim adjustment system preferably is provided between the swivel bracket 42 and the clamping bracket 44 to tilt (raise or lower) the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52 which includes a driveshaft housing 54 and a lower unit 56. The power head 50 is disposed atop the drive unit 34 and houses an internal combustion engine 58 that is positioned within a protective cowling assembly 60. Preferably, the cowling assembly 60 defines a generally closed cavity 62 in which the engine 58 is disposed. The cowling assembly 60 preferably comprises a top cowling member 64 and a bottom cowling member 66. The top cowling member 64 preferably is detachably affixed to the bottom cowling member 66 so that a user, operator, mechanic or repair person can access the engine 58 for maintenance or for other purposes.

The top cowling member 64 preferably has at least one air intake opening 72 and at least one air duct 74 disposed on its rear and top portion. Ambient air is drawn into the closed cavity 62 through the opening 72 and then through the duct 74. Typically, the top cowling member 64 tapers in girth toward its top surface, which is in the general proximity of the air intake opening 72.

The bottom cowling member 66 preferably has an opening at its bottom portion through which an upper portion of an exhaust guide member or support member 78 extends. The exhaust guide member 78 preferably is made of an aluminum-based alloy and is affixed atop the driveshaft housing 54. The bottom cowling member 66 and the exhaust guide member 78 together generally form a tray. The engine 58 is placed onto this tray and is affixed to the exhaust guide member 78. The exhaust guide member 78 in this manner supports the engine 58 above the housing unit 52. The exhaust guide member 78 also has an exhaust discharge passage 80 through which burnt charges (e.g., exhaust gases) from the engine 58 are routed as described below.

The engine 58 in the illustrated embodiment operates on a four-cycle combustion principle. The engine 58 has a cylinder block 84. In the illustrated embodiment, the cylinder block 84 is a unitary component; however, an assembly of components can form it. The presently preferred cylinder block 84 defines four cylinder bores 86 which extend generally horizontally and are generally vertically spaced apart from one another to form a bank 88 (FIG. 3) thereof extending generally vertically. That is, the respective cylinder bores 86 are formed in line. For the reader's convenience, as seen in FIG. 3, the cylinder bores 86 are designated with reference numbers #1, #2, #3 and #4 from the top to the bottom. The rear openings of the cylinder bores 86 face in the same direction as one another. This type of engine, however, merely exemplifies one type of engine on which various aspects and features of the present invention can be suitably used. Engines having other numbers of cylinders, having other cylinder arrangements (e.g., V-type), and operating on other combustion principles (e.g., crankcase compression two-stroke or rotary) also can employ various features, aspects and advantages of the present invention.

A piston 90 reciprocates in each cylinder bore 86 in a well-known manner. A cylinder head 92 is affixed to one end of the cylinder block 84 for closing the cylinder bores 86. The cylinder head 92 preferably defines four combustion chambers 94 together with the associated pistons 90 and cylinder bores 86. Of course, the number of combustion chambers can vary, as indicated above, and more than one cylinder head can be used to define the combination chambers (e.g., separate cylinder heads for each cylinder bore). A crankcase member 96 closes the other end of the cylinder bores 86 to define a crankcase chamber 98 together with the cylinder block 84. A crankshaft 100 extends generally vertically through the crankcase chamber 98 and is journaled for rotation by several bearing blocks in a suitable arrangement. Connecting rods 102 couple the crankshaft 100 with the respective pistons 90 in a well-known manner. While the pistons 90 are connected with the connecting rods 102 for pivotal movement about pivotal axes 104, the crankshaft 100 is connected with the connecting rods 102 for rotation. Thus, the crankshaft 100 can rotate clockwise about a rotational axis 106 as indicated by the arrow 107 of FIG. 2 with the reciprocal linear movement of the pistons 90. In the illustrated embodiment, a longitudinal center plane 108 of the protective cowling assembly 60 that extends generally vertically includes both the pivotal axes 104 of the pistons 104 and the rotational axis 106 of the crankshaft 100.

The crankcase member 96 preferably is located at the most forward position, with the cylinder block 84 and the cylinder head 92 extending rearward from the crankcase member 96, one after another. Generally, the cylinder block 84, the cylinder head 92 and the crankcase member 96 together define an engine body 112. At least these major engine portions 84, 92, 96 preferably are made of aluminum based alloy. The aluminum alloy advantageously increases strength over cast iron while decreasing the weight of the engine body 112.

The engine 58 comprises an air induction system 116. The air induction system 116 delivers air to the combustion chambers from the interior cavity 62 of the protective cowling assembly 60. The air induction system 116 preferably comprises a plurality of inner intake passages 118 (four in the illustrated embodiment), a plurality of outer intake passages 120 (four in the illustrated embodiment), and at least one plenum chamber 122 (one in the illustrated embodiment). In the illustrated embodiment, the inner intake passages 118 are bifurcated to define two intake ports 119 per a combustion chamber 94 in the cylinder head 92 so that eight intake ports 119 are formed for the engine 58; however, the cylinder head can define more or less intake ports per cylinder. Intake valves 124 are provided to selectively open and close the respective intake ports 119. When each intake port 119 is opened, the corresponding intake passage 120 communicates with the associated combustion chamber 94.

The respective outer intake passages 120 preferably comprise intake conduits 126 and carburetors 127. The intake conduits 126 preferably are formed with an upstream piece and a downstream piece per each conduit 126 and carburetors 127 are interposed between the respective pieces of the intake conduits 126.

Each carburetor 127 has a throttle valve 128 journaled therein for pivotal movement about an axis of a valve shaft that extends generally vertically. The respective valve shafts are linked together so that the throttle valves 126 are operable by the operator through an appropriate conventional linkage mechanism. The throttle valves measure or regulate an amount of air flowing through the respective air intake passages 120. Normally, the greater the opening degree, the higher the rate of airflow and the higher the engine speed. The air is introduced into the intake passages 120 from within the cavity 62 through an air inlet 129 of the plenum chamber 122 which preferably is commonly defined with the upstream pieces of the intake conduits 126.

The engine 58 also comprises the exhaust system 32 that routes burnt charges or exhaust gases to a location outside of the outboard motor 30. The exhaust system 32 preferably is placed on the opposite side of the induction system 116 relative to the bank of cylinder bores 88. The exhaust system 32 includes four exhaust passages 130 defined within the cylinder head 92. As seen in FIG. 3, the exhaust passages 130 are designated as 130*a*, 130*b*, 130*c* and 130*d* from the top to the bottom. Like the inner intake passages 118, each exhaust passage 130 preferably is bifurcated to define a pair of exhaust ports 132 per combustion chamber 94; however, the cylinder head can define more or less exhaust ports per cylinder. Exhaust valves 134 are provided to selectively open and close the respective exhaust ports 132. When each exhaust port 132 is opened, the corresponding exhaust passage 130 communicates with the associated combustion chamber 94.

A pair of exhaust manifolds 138, 140 preferably are defined aside and next to the cylinder bank 88 in the cylinder block 84. That is, the exhaust manifolds 138, 140 extend generally vertically and in parallel with each other and with the cylinder bank 88. The inner and outer exhaust manifolds 138, 140 communicate with the exhaust passages 130 to collect exhaust gases from the combustion chambers 94 through the respective exhaust ports 132. In the illustrated embodiment, the exhaust manifolds 138, 140 are coupled together within the exhaust guide member 78 and also are connected to the exhaust discharge passage 80 within the exhaust guide member 78. In other words, the respective exhaust manifolds 138, 140 join together at a location lower than the lower-most cylinder bore #4. When the exhaust ports 132 are opened, the combustion chambers 94 communicate with the exhaust discharge passage 80 through the exhaust manifolds 138, 140. The construction and the arrangement of the exhaust manifolds 138, 140 will be described in greater detail below with reference to FIGS. 3–5.

A valve cam mechanism is provided for actuating the intake and exhaust valves 124, 134. In the illustrated embodiment, the cylinder head 92 journals a double camshaft arrangement, which extends generally vertically. The camshaft arrangement preferably includes an intake camshaft 144 and an exhaust camshaft 146. The camshaft 144, 146 actuate the intake valves 124 and the exhaust valves 134, respectively. Each top of the valves 124, 134 is provided with a valve lifter 148. While bias springs 150 urge the valve lifters 148 to place the respective valves 124, 134 in the closed positions, the camshafts 144, 146 have cam lobes 152 that push the valve lifters 148 to move the valves 124, 134 toward the open positions in a controlled timing. In the illustrated embodiment, the cam lobes 152 are arranged to bring the intake valves 124 and the exhaust valves 134 both belonging to the same combustion chambers 94 in the open positions simultaneously at least for awhile. That is, the duration of valves opening for the corresponding intake and exhaust valves 124, 134 overlap with each other. Camshaft cover members 154 cover the respective camshafts 144, 146. Other conventional valve drive mechanisms can be employed instead of a mechanism using one or more camshafts.

A camshaft drive mechanism is provided for driving the valve cam mechanism. The camshafts 144, 146 have driven sprockets 156 (FIG. 1) positioned atop thereof and the crankshaft 100 has a drive sprocket 158 positioned almost atop thereof. A timing chain or belt 160 is wound around the drive and driven sprockets 156, 158. The crankshaft 100 thus drives the camshafts 144, 146 with the timing chain 160 in a timed relationship. A diameter of the driven sprockets 156 preferably is twice as large as a diameter of the drive sprocket 158. The camshafts 144, 146 thus rotate at half of the speed of the rotation of the crankshaft 100.

The engine 58 preferably has a fuel supply system that includes the carburetors 127. The fuel system includes a fuel tank, which is typically placed in the associated watercraft 40, a fuel pump 164 mounted on the intake camshaft cover member 154, and fuel conduits 166 arranged to connect the components with each other. The intake camshaft 144 preferably operates the fuel pump 164 through the cam lobe 152, a cantilever 168 and a pump piston 170. The fuel pump 164 delivers fuel from the fuel tank to the carburetors 127. The carburetors 127 regulates an amount of the fuel in proportion to the amount of the air to obtain an appropriate air/fuel ratio of the charge delivered to the intake passages 120. Of course, a direct or indirect fuel injection system or other fuel charge formers can replace the carburetor system.

The engine 58 further comprises an ignition or firing system. Each combustion chamber 94 is provided with at least one spark plug 174. The spark plugs 174 preferably are connected to an ECU (electronic control unit) that can control ignition timings of the spark plugs 174. The spark plugs 174 have electrodes that are exposed into the associated combustion chamber 94 and that ignite an air/fuel charge in the combustion chamber 94 at selected ignition timings. In the illustrated embodiment, the ignition timings are given to #1, #3, #4 and then #2 cylinders in this order. This firing order is indicated by Roman numerals in parentheses (I), (II), (III), (IV) of FIG. 3.

The ignition system preferably has an ignition coil and an igniter. The ignition coil preferably is a combination of a primary coil element and a secondary coil element that are wound around a common core. Desirably, the secondary coil element is connected to the spark plugs 174, while the primary coil element is connected to the igniter. Also, the primary coil element is coupled with a power source so that electrical current flows therethrough. The igniter abruptly cuts off the current flow in response to an ignition timing control signal from the ECU and then a high voltage current flow occurs in the secondary coil element. The high voltage current flow forms a spark at each spark plug 174.

In the illustrated engine 58, the pistons 90 reciprocate between top dead center and bottom dead center. When the crankshaft 100 makes two rotations, the pistons 90 generally move from the top dead center to the bottom dead center (the intake stroke), from the bottom dead center to the top dead center (the compression stroke), from the top dead center to the bottom dead center (the power stroke) and from the bottom dead center to the top dead center (the exhaust stroke). During the four strokes of the pistons 90, the camshafts 144, 146 make one rotation and actuate the intake and exhaust valves 124, 134 to open the intake ports 119 during the intake stroke and to open exhaust ports 132 during the exhaust stroke, respectively.

Generally, at the beginning of the intake stroke, air preferably is drawn through the air intake passages 120 and fuel preferably is supplied into the intake passages 120 by the carburetors 127. The air and the fuel thus are mixed to form the air/fuel charge in the combustion chambers 94. Slightly before or during the power stroke, the respective spark plugs 174 ignite the compressed air/fuel charge in the respective combustion chambers 94.

As noted, in the illustrated embodiment, the ECU fires the spark plugs 174 of the cylinders #1, #3, #4 and #2 in this order. The air/fuel charge thus rapidly bums during the power stroke to move the pistons 90 toward bottom dead center in the respective cylinders. The burnt charge, i.e., exhaust gases, then are discharged from the combustion chambers 94 during the exhaust stroke. In the illustrated embodiment, the timings of the exhaust ports 132 that are associated with the combustion chambers 94 fired consecutively can overlap. It should be noted, however, that the exhaust ports 132 associated with the combustion chambers 94 that are not fired consecutively are not open at the same time, as described in greater detail below.

During the engine operation, heat builds in the engine body 112 and in various peripheral engine components disposed around the engine body 112. The engine 58 includes a cooling system to reduce the temperature of the engine. In the illustrated arrangement, the engine body 112 has one or more water jackets 178 through which water runs to remove the heat from the engine body 112 and the engine components. The outboard motor 30 preferably employs an open-loop type water cooling system that introduces cooling water from the body of water surrounding the motor 30 and then returns the water to the water body. The water inlet and outlet can be defined in the housing unit 52.

The engine 58 preferably includes a lubrication system. Although any type of lubrication systems can be applied, a closed-loop type of system is employed in the illustrated embodiment. The lubrication system comprises a lubricant tank 180 defining a reservoir cavity 182 preferably positioned within the driveshaft housing 54 below the exhaust guide member 78; however, other locations of the lubrication tank 180 also are possible. In some applications, the lubricant tank 180 is not positioned within the outboard motor 30 (i.e., the tank is positioned on the watercraft rather than on the outboard motor), while in other applications a lubricant holding tank is integrally formed with the crank chamber. An oil pump preferably is provided at a desired location, such as a lowermost portion of the crankshaft 100, to draw the lubricant oil from the reservoir 182 through a suction pipe and to pass the lubricant oil toward engine portions, which are desirably lubricated, through lubricant delivery passages within the engine body 112. The engine portions that need lubrication include, for instance, the crankshaft bearings, the connecting rods 102 and the pistons 90. Lubricant return passages also are provided to return the oil to the lubricant tank 180 for re-circulation. Preferably, the lubrication system further comprises a filter assembly to remove foreign matter (e.g., metal shavings, dirt, dust and water) from the lubricant oil before the lubricant is re-circulated or delivered to the various engine portions.

A flywheel assembly 186 preferably is positioned above atop the crankshaft 100 and is mounted for rotation with the crankshaft 100. The illustrated flywheel assembly 186 comprises a flywheel magneto or AC generator that supplies electric power to various electrical components such as the ignition system and the ECU.

The driveshaft housing 54 depends from the power head 50. More specifically, a top end of the illustrated driveshaft housing 54 is affixed to the bottom end of the exhaust guide member 78. The driveshaft housing 54 supports a driveshaft 188 which is driven by the crankshaft 100. The driveshaft 188 extends generally vertically through the driveshaft housing 54. The driveshaft housing 54 also defines internal passages which form portions of the exhaust system 32. The internal passages include an exhaust pipe 190 depending from the exhaust guide member 78 and an exhaust expansion chamber 192. The exhaust pipe 190 connects the exhaust discharge passage 80 of the exhaust guide member 78 to the expansion chamber 192 which is defined downstream the exhaust pipe 190. The expansion chamber 192 has a relatively large volume so that the exhaust gases from the exhaust pipe 190 can be abruptly expanded within the expansion chamber 192 to lose the exhaust energy and thus reduce exhaust noise. An idle discharge section preferably branches off from the exhaust discharge passage 80 and opens to the atmosphere above the body of water through an idle discharge port 194. A relatively small expansion chamber 196 preferably is formed upstream the discharge port 194. An apron 198 preferably covers an upper portion of the driveshaft housing 54 and improves the overall appearance of the outboard motor 30. The idle discharge port 194 extends out through the apron 198.

The lower unit 56 depends from the driveshaft housing 54 and supports a propulsion shaft 200, which is driven by the driveshaft 188. The propulsion shaft 200 extends generally horizontally through the lower unit 56. A propulsion device is attached to the propulsion shaft 200 and is powered through the propulsion shaft 200. In the illustrated arrangement, the propulsion device is a propeller 202 that is affixed to an outer end of the propulsion shaft 200. The propulsion device, however, can take the form of a dual counter-rotating propeller system, a hydrodynamic jet, or any of a number of other suitable propulsion devices.

A transmission 204 preferably is provided between the driveshaft 188 and the propulsion shaft 200. The transmission 204 couples together the two shafts 188, 200 which lie generally normal to each other (i.e., at a 90° shaft angle) with bevel gears. The outboard motor 30 has a switchover or clutch mechanism 206 that allows the transmission 204 to change the rotational direction of the propeller 200 among forward, neutral or reverse.

The lower unit 56 also defines an internal passage that forms a discharge section of the exhaust system 32. The discharge section includes an exhaust expansion chamber 210 that occupies a major volume of the section and is formed above a space where the propulsion shaft 200 extends. At engine speeds above idle, the majority of the exhaust gases are discharged toward the body of water through a discharge passage 211 formed within a hub of the propeller 200. At the idle speed of the engine 58, the exhaust gases are primarily discharged through the idle discharge section because the exhaust pressure under this condition is smaller than the back pressure created by the body of water.

The cooling system includes a water inlet 212 formed in the lower unit 56, a water pump 214 driven by the driveshaft 188 and water conduits 216 arranged to couple the components together and with the water jackets 178 in the engine body 112. The water that has passed through the water jackets 178 can be used to cool other engine components or portions of the exhaust system 32 and then can finally be discharged to the body of water through water discharge slits 218 formed in the lower unit 56. Otherwise, fresh water can be delivered directly to such components and portions without circulating through the water jackets 178 of the engine body 112.

With primary reference to FIGS. 2–5, and reference still to FIG. 1, a portion of the exhaust system 32 that includes the exhaust passages 130 and the exhaust manifolds 138, 140 configured in accordance with a preferred embodiment of the present invention will now be described in great detail.

As described, the cylinder bores 86 are spaced apart vertically from one another to define the cylinder bank 88. As seen in FIGS. 3 and 4, the exhaust manifold 138, which is disposed closer to the cylinder bank 88 than the other manifold 140, comprises an upper connecting section 230, a lower connecting section 232 and a downpipe section 234. Both the upper and lower connecting sections 230, 232 communicate with the downpipe section 234 that is positioned downstream of the connecting sections 230, 232. The upper and lower connecting sections 230, 232 also are disposed between the ends of the exhaust passages 130*a*, 130*d* and the downpipe section 234 of the exhaust manifold 138.

The upper connecting section 230 in the illustrated embodiment is defined between a rearward facing opening 236 and a front facing opening 238. The rearward facing opening has an elongated elliptical shape and is sized such that its upper periphery generally matches the shape of the front facing end of the exhaust passage 130*a*, except for the lower edge of the exhaust passage 130*a*, as best seen in FIG. 3.

The front facing opening 238 is disposed opposite of a lower end of the rearward facing opening 236 and opens into the downpipe section 234 of the manifold. The front facing opening 238 also has an elliptical shape in the illustrated embodiment, but is significantly smaller than and not as elongated as the rearward facing opening 236. The front facing opening 238 preferably is equal in size to the front facing end of the exhaust passage 130*a*. The front facing opening 238 preferably is disposed near the mid-height of the exhaust manifold 138.

Because of the difference is the sizes of the openings 236, 238, and the staggered vertical positioning of the points where the rearward facing opening 236 communicates with the exhaust passage 130*a* and the front facing opening 238 communicates with the downpipe section 234, the connecting section 230 includes a vertical jog 240. The vertical jog 240 has a generally rectangular cross-sectional shape, as best seen by the cross-sections illustrated in FIGS. 2 and 4, with a rear surface of the vertical jog 240 being defined by a front facing wall of the cylinder head 92. The cross-sectional flow area through the vertical jog 240 desirably is generally equal to the cross-sectional flow area through the exhaust passage 130*a* and through the downpipe section 234.

The lower connecting section 232 has a similar configuration to that of the upper connecting section 230. The lower connecting section 232 is defined between a rearward facing opening 244 and a front facing opening 246. The rearward facing opening 244 has an elongated elliptical shape and is sized such that its lower periphery generally matches the shape of the front facing end of the exhaust passage 130*d*, except for the upper edge of the exhaust passage 130*d*, as best seen in FIG. 3. As thus described, both the upper and lower rear ends 236, 244 face the same direction as do the ends of the respective cylinder bores 86 (i.e., rearward in the illustrated embodiment).

The front facing opening 246 is disposed opposite of an upper end of the rearward facing opening 244 and opens into the downpipe section 234 of the manifold. The front facing opening 246 also has an elliptical shape in the illustrated embodiment, but is significantly smaller than and not as elongated as the rearward facing opening 244. The front facing opening 246 preferably is equal in size to the front facing end of the exhaust passage 130*d*. The front facing opening 246 preferably is disposed near the mid-height of the exhaust manifold 138.

Because of the difference is the sizes of the openings 244, 246, and the staggered vertical positioning of the point where the rearward facing opening 244 communicates with the exhaust passage 130*d* and the point where the front facing opening 246 communicates with the downpipe section 234, the lower connecting section 232 includes an upward extending vertical jog 248. The vertical jog 248 has a generally rectangular cross-sectional shape, as best seen by the cross-sections illustrated in FIG. 4, with a rear surface of the vertical jog 248 being defined by a front facing wall of the cylinder head 92. The cross-sectional flow area through the vertical jog 248 desirably is generally equal to the cross-sectional flow area through the exhaust passage 130*d* and through the downpipe section 234 of the manifold 138. The front wall of the vertical jog 248 forms a baffle between the lower connecting section 232 and the downpipe section 234, as best seen in FIG. 4.

Figure 2:
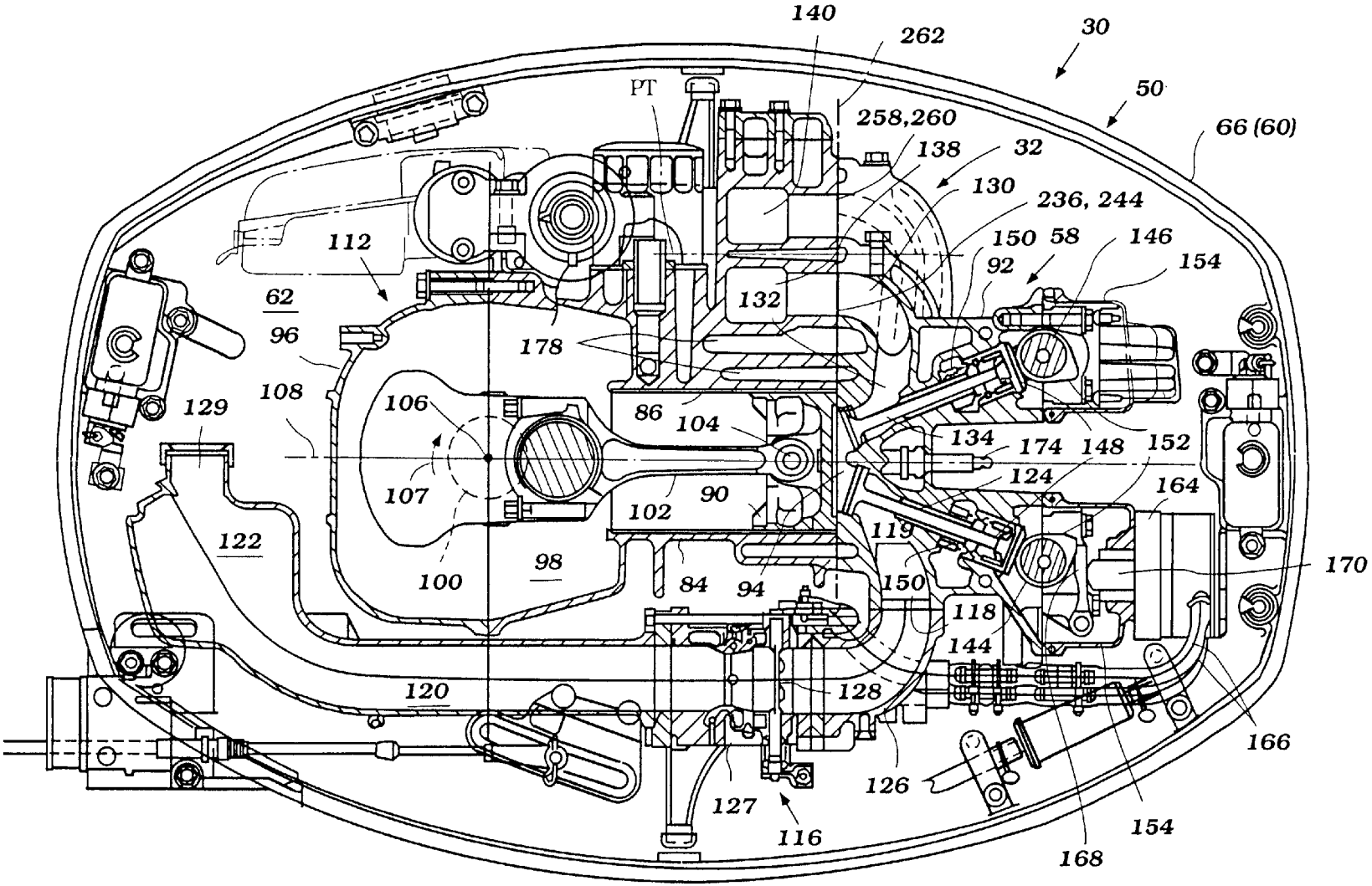
FIG. 2 is an enlarged top plan view of the outboard motor. A top cowling member is detached, and an engine of the outboard motor is shown in section taken along the line 2—2 of FIG. 1.
Figure 3:
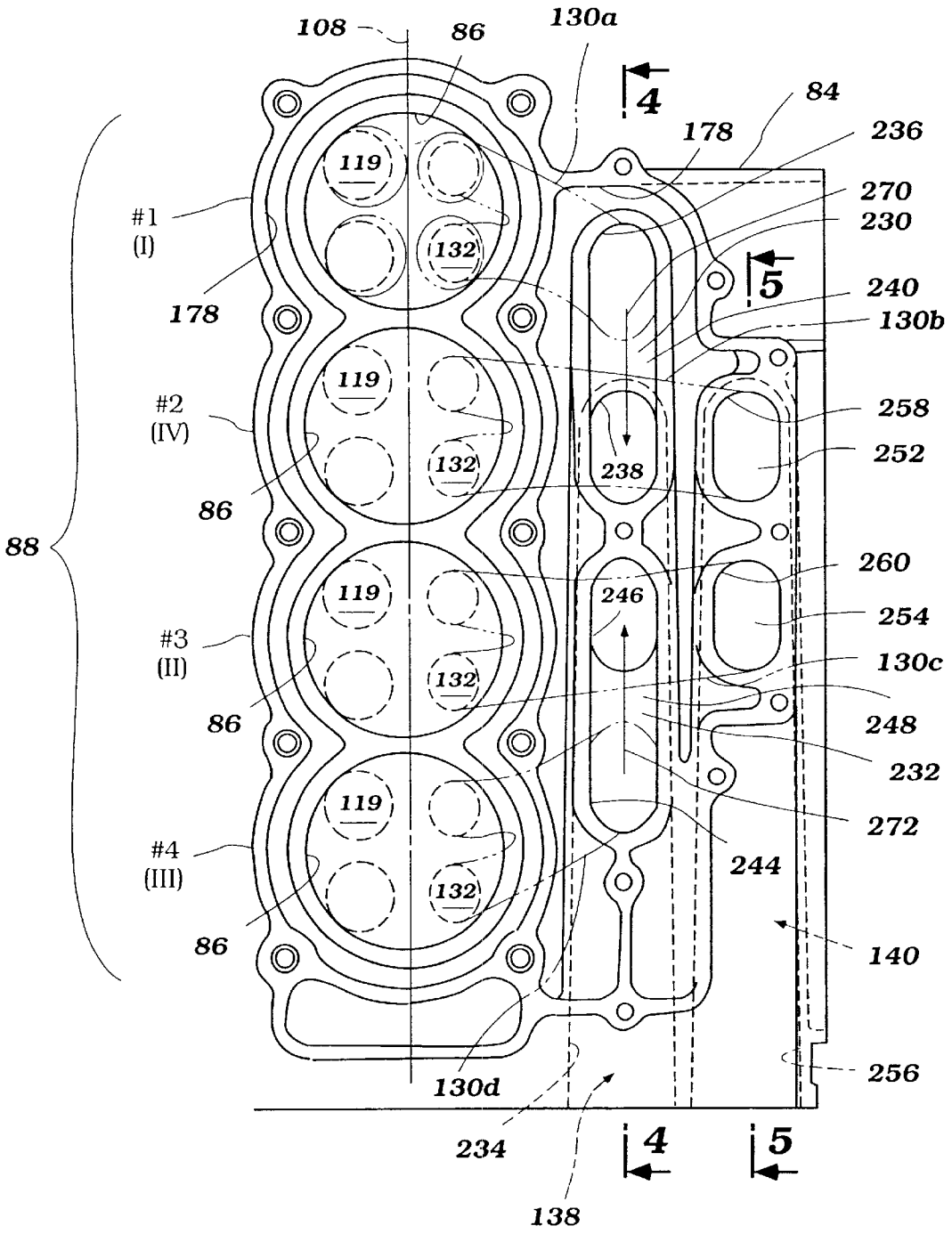
FIG. 3 is a partial rear view of a cylinder block defining cylinder of the engine bores and exhaust manifolds.
Figure 4:
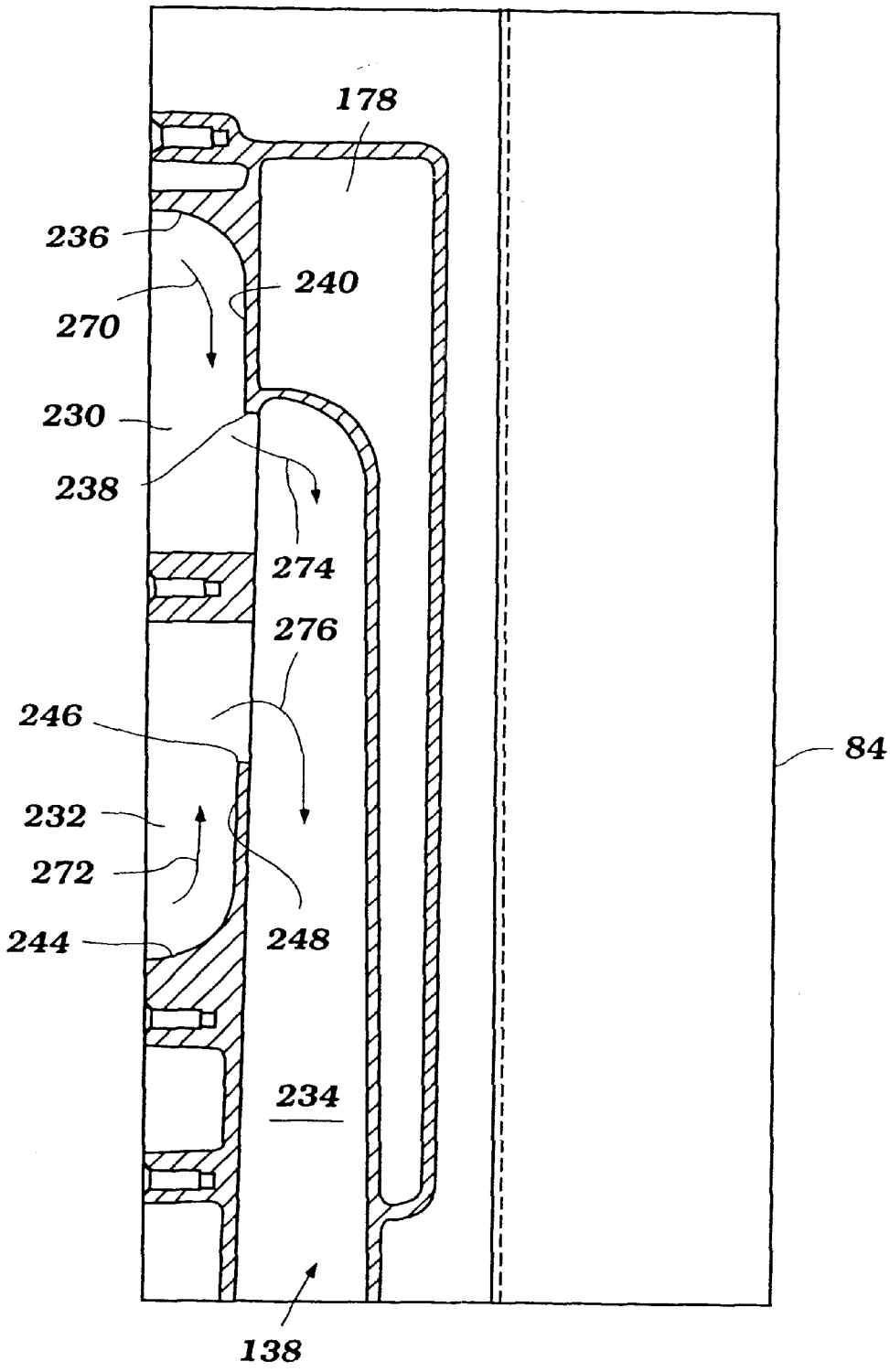
FIG. 4 is a sectional view of the cylinder block taken along the line 4—4 of FIG. 3.
Figure 5:
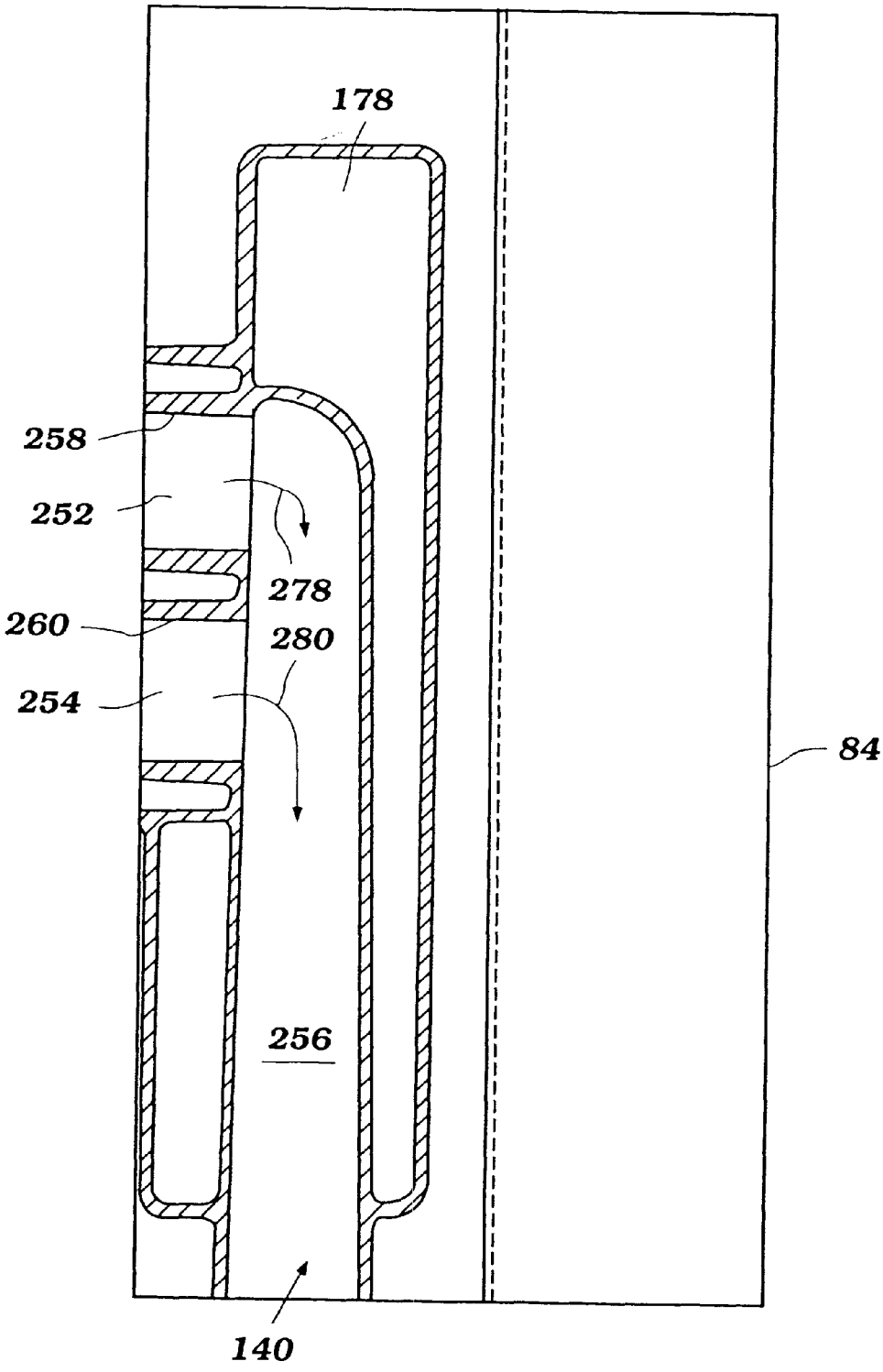
FIG. 5 is a sectional view of the cylinder block taken along the line 5—5 of FIG. 3.

As seen in FIGS. 3 and 5, the exhaust manifold 140 comprises an upper inlet section 252, a lower inlet section 254 and a downpipe section 256. Both the upper and lower inlet sections 252, 254 communicate with the downpipe section 256 that is disposed at a downstream position relative to the inlet sections 252, 254. The upper inlet section 252 has an upper rear opening 258 that opens rearward at generally the same height as the opening 238 of the inner exhaust manifold 138. The lower inlet section 254 in turn has an lower rear opening 260 that opens also rearward at generally the same height as the opening 246 of the inner exhaust manifold 138. Like the upper and lower rear ends 236, 244 of the inner exhaust manifold 138, these rear openings 258, 260 of the outer manifold 140 face in the same direction as the ends of the respective cylinder bores 86 face. In addition, as best seen in FIG. 2, all the rear ends 236, 244, 258, 260 and the ends of the respective cylinder bores 86 are located on the same plane 262 which extends transversely and normal to the longitudinal center plane 108.

Both of the inlet sections 252, 254 have complimentary shapes to that of the respective exhaust passages 130*b*, 103*c*.

In the illustrated embodiment, the inlet sections 252, 254 have generally elliptical shapes and are of a generally uniform cross-section. The inlet sections 252, 254 desirably provide about the same size cross-sectional flow area that the connecting sections 230, 232 provide. Thus, as best seen in FIG. 3, the inlet sections 252, 254 have generally the same shape and size as the front facing openings 238, 246 of the connecting sections 230, 232.

As seen in FIGS. 2–5, the water jacket 178 surrounds the exhaust manifolds 138, 140, particularly, the downpipe sections 234, 256. The waterjacket 178 also extends around the connecting sections 230, 232 and partially about the inlet sections 252, 254, as best seen in FIG. 3.

The cylinder head 92 is coupled with the cylinder block 84 on the rear surface thereof in a well-known manner using bolts or other suitable fasteners. The coupling is done so that the top exhaust passage 130*a* of the cylinder head 92 connects the exhaust ports 132 of the cylinder #1 to the exhaust manifold 138, the second exhaust passage 130*b* connects the ports 132 of the cylinder #2 to the exhaust manifold 140, the third exhaust passage 130*c* connects the ports 132 of the cylinder #3 to the exhaust manifold 140, and the bottom exhaust passage 130*d* connects the ports 132 of the cylinder #4 to the exhaust manifold 138. That is, while two of the exhaust passages 130 are coupled with the exhaust manifold 138, the other two are coupled with the other exhaust manifold 140. In addition, two of the exhaust passages 130 associated with the combustion chambers 94 which have consecutive firing orders are separately allotted to the different exhaust manifolds 138, 140. For example, because the exhaust passage 130*b* is associated with the cylinder #2, whose firing immediately proceeds the firing of cylinder #1, the exhaust passage 130*b* is allotted to the outer exhaust manifold 140 that extends separately from the inner exhaust manifold 138 to which the exhaust passage 130*a* is coupled; the exhaust passage 130*a* communicates with the combustion chamber 94 of cylinder #1. In the same logic, because cylinder #3 and cylinder #4 are sequentially fired, the respective exhaust passages 130*c*, 130*d* communicate with different exhaust manifolds 138, 140. In particular, exhaust passage 130*d* communicates with the inner exhaust manifold 138 while the exhaust passage 130*c* communicates with the outer exhaust manifold 140.

The exhaust passages 130*a*, 130*d*, which are associated with the combustion chambers 94 that are not fired consecutively, thus are coupled to the same exhaust manifold 138, and that the exhaust passages 130*b*, 130*c*, which also are associated with the combustion chambers 94 that are not fired consecutively, are coupled to the other exhaust manifold 140. This arrangement takes advantage of the fact that the timings of the exhaust ports of the #1 and #4 cylinders do not overlap and the timings of the exhaust ports of the #2 and #3 cylinders do not overlap. Because the exhaust ports of only one of the two cylinders that are connected to the same exhaust manifold are open at any given time, exhaust gas interference between the two cylinders is avoided. For example, the initial reflected exhaust pressure pulse from the #1 cylinder does not interfere with the exhaust cycle of the #4 cylinder, and vise versa. The same is true for cylinders #2 and #3.

As seen in FIGS. 2 and 3, the exhaust passages 130*a*, 130*d* have a similar configuration with each other except for the directions in which they bend and their lengths. The exhaust passage 130*a* bends generally downwardly, while the exhaust passage 130*d* bends generally upwardly. Also, the exhaust passages 130*b*, 130*c* have a similar configuration to each other except for their bending directions: exhaust passage 130*b* bends downward while exhaust passage 130*c* bends upward.

As best seen in FIG. 2, the middle exhaust passages 130*b*, 130*c* have longer lengths than do the upper and lower exhaust passages 130*a*, 130*d*. The longer exhaust passages 130*b*, 130*c* extend out to the outer manifold 140. The shorter exhaust passages 130*a*, 130*d* extend to the inner manifold 138. In the illustrated embodiment, the short exhaust passages 130*a*, 130*d* extend along a first arcuate path and the longer exhaust passages 130*b*, 130*c* extend along a second arcuate path. The first arcuate path extends through at least one radius of curvature that is smaller than a corresponding radius of curvature of the second arcuate path. While in the illustrated embodiment, the longer exhaust passages 130*b*, 130*c* have the same general shape as each other and the shorter exhaust passages 130*a*, 130*d* have the same general shape as each other, it is understood that the exhaust passages 130 can all have slightly different shapes and lengths.

The exhaust gases coming from cylinders #1 and #4 flow through the respective exhaust passages 130*a*, 130*d*, then through the respective connecting sections 230, 232 of the exhaust manifold 138, as shown by the arrows 270, 272 of FIGS. 3 and 4, respectively, and enter the downpipe section 234 through the respective opening 238, 244, as illustrated by the arrows 274, 276, respectively. Meanwhile, the exhaust gases coming from cylinders #2 and #3 flow through the exhaust passages 130*a*, 130*d*, thence through the inlet sections 252, 254 and into the downpipe section 256 of the outer exhaust manifold 140 through the openings 258, 260 as shown by the arrows 278, 280, respectively.

An exhaust path thus is formed from the exhaust ports 130 of each cylinder 86 to a location where the exhaust manifolds 138, 140 join together in the exhaust guide 78. A first exhaust path leading from the first cylinder includes the exhaust passage 130*a*, the connecting section 230, and the downpipe section 234 of the inner manifold 138. A second exhaust path leading from the second cylinder includes the exhaust passage 130*b*, the inlet section 252 and the downpipe section 256 of the outer manifold. A third exhaust path leading from the third cylinder includes the exhaust passage 130*c*, the inlet section 254 and the downpipe section 256 of the outer manifold 140. A fourth exhaust path leading from the fourth cylinder includes the exhaust passage 130*d*, the connecting section 232, and the downpipe section 234 of the inner manifold 138.

As best understood from FIG. 3, the lengths of each of the four paths are roughly equal to one another. This result is achieved by arranging the first exhaust path to have generally the shortest length possible for it and then designing the other exhaust paths to generally match this length. The second and third exhaust paths are elongated by extending the exhaust passages 130*b*, 130*c* outward to communicate with the outer exhaust manifold. The fourth exhaust path is elongated by the inclusion of the connecting section 232. The connecting section 230, however, does not make the first exhaust path longer.

In addition, corresponding sub-paths of the respective exhaust paths, which are defined from the respective exhaust ports to the downpipe section of the respective manifold, also are roughly equal to each other. The generally symmetrical shape of the exhaust passages 130*a*, 130*d* and the connecting sections 230, 232, relative to a mid-point between the #1 and #4 cylinders, ensure this result for the exhaust passages associated with the #1 and #4 cylinders. Similarly, the generally symmetrical shape of the exhaust passages 130*b*, 130*c* and the inlet sections 252, 254, relative to a mid-point between the #2 and #3 cylinders, ensures this result for the exhaust passages associated with the #2 and #3 cylinders.

The elongated lengths of the second, third and fourth exhaust paths and sub-paths enhance the pulsation wave effect at the exhaust ports of the respective cylinders (i.e., cylinders #2, #3 and #4) for operation at higher speeds. Accordingly, the charging efficiency of these cylinders increases while the exhaust manifold construction is compact. That is, the above-described exhaust system arrangement creates the desired pulsation wave effect despite the exhaust manifolds 138, 140 being disposed within a relatively narrow and small space. The pulsation wave effect produces high engine performance (torque) for a specific range of the engine speed. The range is determined in connection with the configuration and lengths of the exhaust system, as is well known. In addition, because the lengths of the exhaust paths are roughly equal to one another as thus described, each cylinder 86 experiences substantially the same pulsation wave effect.

In addition, the illustrated construction of the exhaust system is compact enough for the limited space within the outboard motor despite using two exhaust manifolds. The effective lengths of the exhaust paths are increased without a significant increase in the overall exhaust manifold size.

The present exhaust system thus achieves these results—an effective and generally equal pulsation wave effect for each cylinder, minimal exhaust interference between cylinders, and a compact construction—due at least in part to the use of the dual exhaust manifold construction, in which two manifolds are arranged side-by-side on one side of the cylinder body, and the use of a detour in at least one of the exhaust paths; however, an exhaust system need not include both of these features to achieve some of the above-noted advantages.

As apparent from the above example, the connecting section 232 forms a detour in the path from the exhaust passage 130*d* to the downpipe 234 of the inner manifold 138 to lengthen the exhaust path. A "detour" as used herein is a deviation from a shorter, more direct route to an indirect route so as to lengthen the route. Thus, while the lower connecting section 232 is a detour, the upper connecting section 230 is not.

In the illustrated embodiment, the cylinder block 84 can easily be cast because most of the end openings face the same direction. In addition, either the cylinder block 84 or the cylinder head 92, or both of them, can be formed by a plurality of pieces (i.e., an assembly) or by a single cast component. For example, a portion of the cylinder block 84 including the outer exhaust manifold 140 and a portion of the cylinder head 92 joining the portion of the cylinder block 84, i.e., the portions located outer than the line PT of FIG. 2, can be formed by separate pieces, respectively. These separated pieces also can be unitarily formed as a one piece. That is, both the separated cylinder block piece and the cylinder head piece can be unified.

The openings 238, 246 of the exhaust manifold 138 can be unitarily formed as a single slot that has substantially the same size as two of the openings 238, 246. Another variation uses a single opening that is formed at the mid way location and has substantially the same size as one of the openings 238, 246. This single opening can replace the two openings 238, 246 with the two connecting sections 230, 232 joining at the single opening. The outer exhaust manifold 140 also can be provided with one or more detours similar to the detour formed by the lower connecting section 232. In addition, both or either one of the exhaust manifolds 138, 140 can have one or more rear end openings 236, 244, 258, 260 that are (is) not leveled with the ends of the cylinder bores 86 (i.e., one or more of the rear openings do not lie within the same transverse vertical plane on which the ends of the cylinder bores lie). Further, the exhaust manifolds 138, 140 can merge together at any locations other than the location within the exhaust guide member 78 such as a location within the cylinder block 84 or a location within the driveshaft housing 54.

Figure 6:
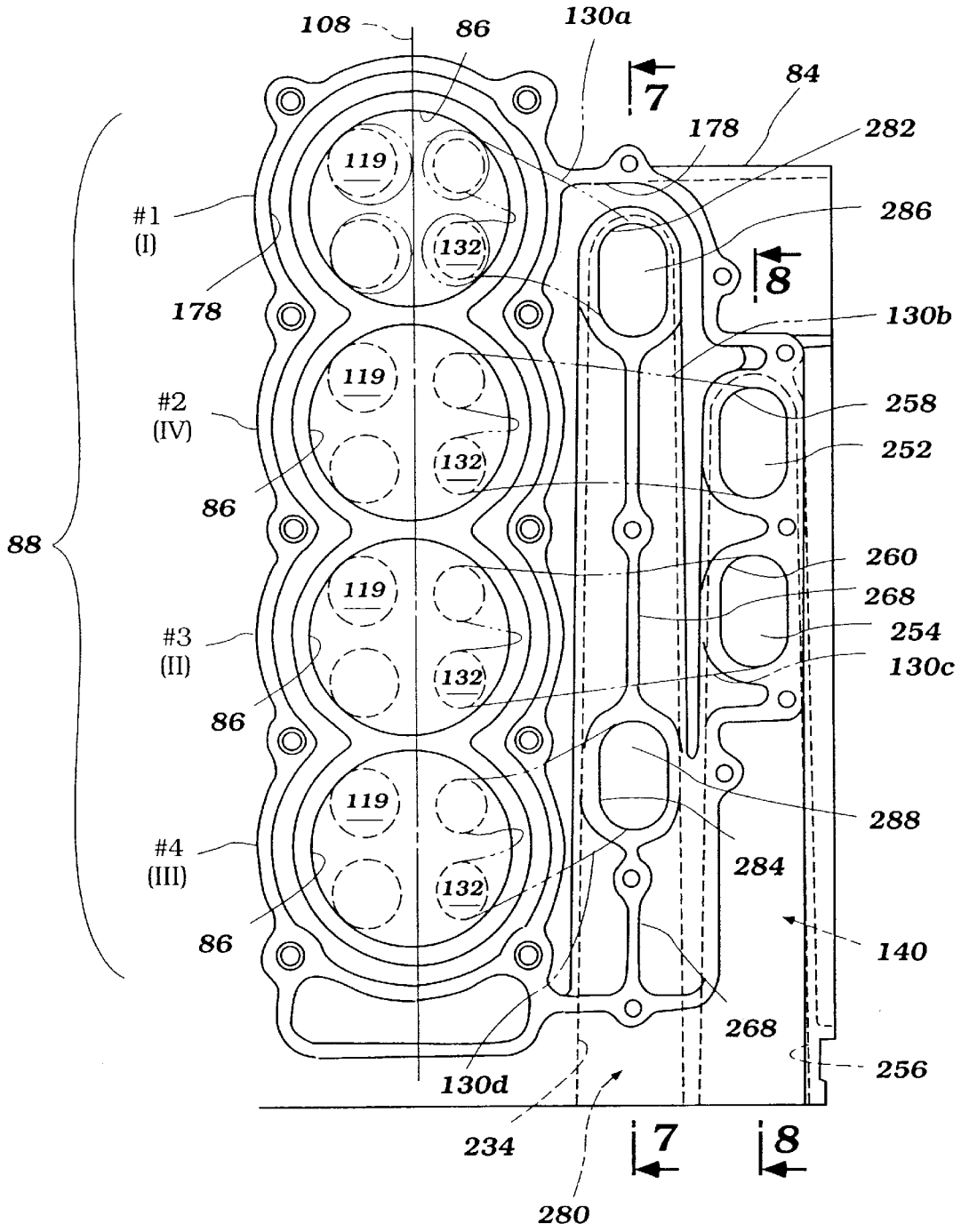
FIG. 6 is a partial rear view of a cylinder block configured in accordance with another embodiment of the present invention.
Figure 7:
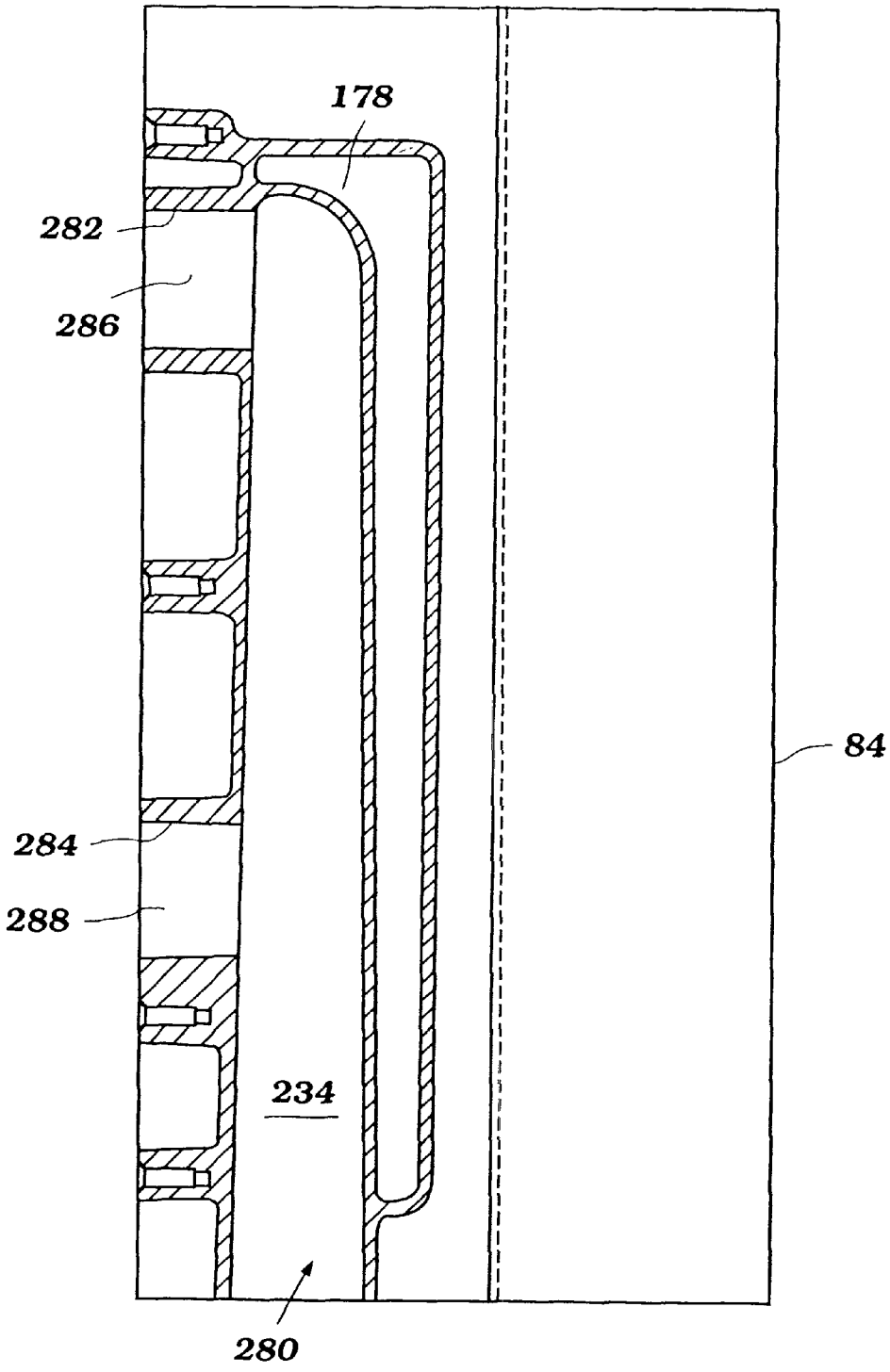
FIG. 7 is a sectional view of the cylinder block taken along the line 7—7 of FIG. 6.
Figure 8:
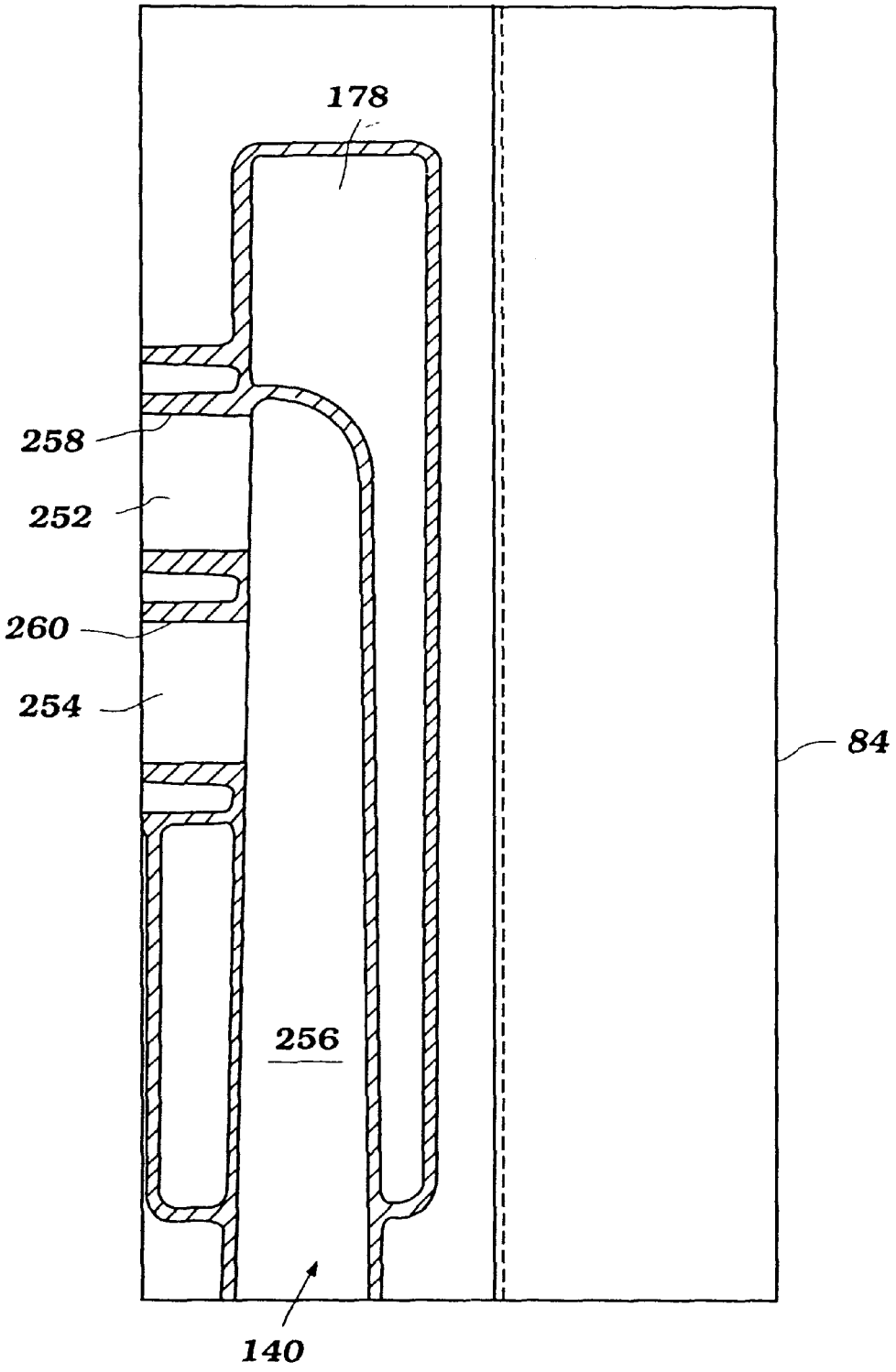
FIG. 8 is a sectional view of the cylinder block taken along the line 8—8 of FIG. 6.

For a more simple construction, the detour section is not necessarily provided. FIGS. 6–8 illustrate another embodiment of the exhaust system. The same components and members as those described already are assigned the same reference numerals and will not be described again. In this embodiment the exhaust path lengths are different.

The cylinder block 84 in this embodiment has an exhaust manifold 280 that replaces the exhaust manifold 138 of the first embodiment. The structure of the exhaust manifold 280 has no detour sections. The exhaust gases coming from the combustion chambers 94 associated with the exhaust passages 130*a*, 130*d* (i.e., from the #1 and #4 cylinders) directly enter the manifold area 234 through openings 282, 284 and inlet sections 286, 288, respectively. Although the pulsation wave effect in this embodiment is significantly less than the effect obtain with the exhaust system structure of the first embodiment, no interference occurs between the exhaust gas pulses coming from different exhaust ports. The construction of the cylinder block 84, however, is simpler than the first embodiment because no detour sections are provided.

Figure 9:
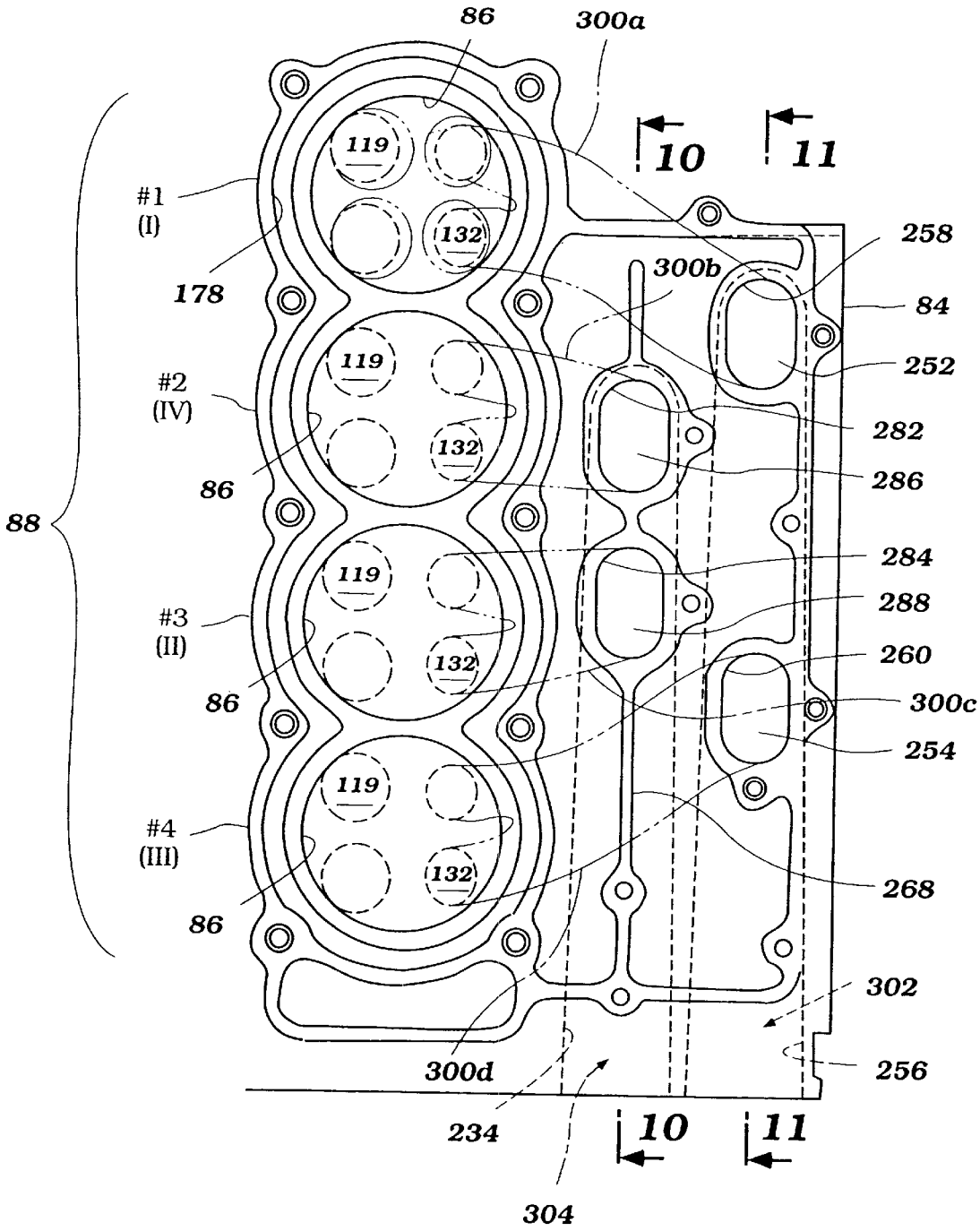
FIG. 9 is a partial rear view of a cylinder block configured in accordance with an additional embodiment of the present invention.
Figure 10:
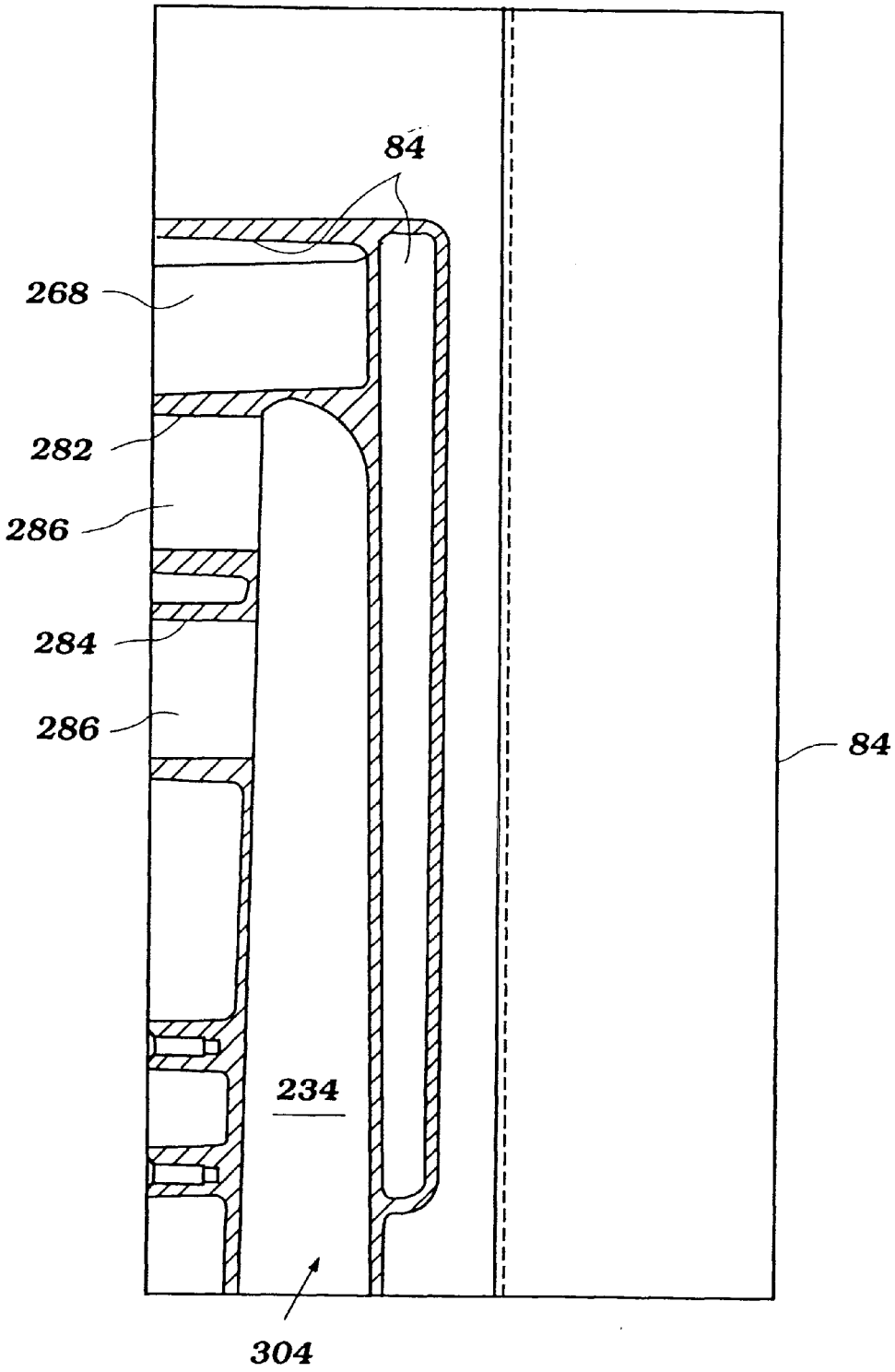
FIG. 10 is a sectional view of the cylinder block taken along the line 10—10 of FIG. 9.
Figure 11:
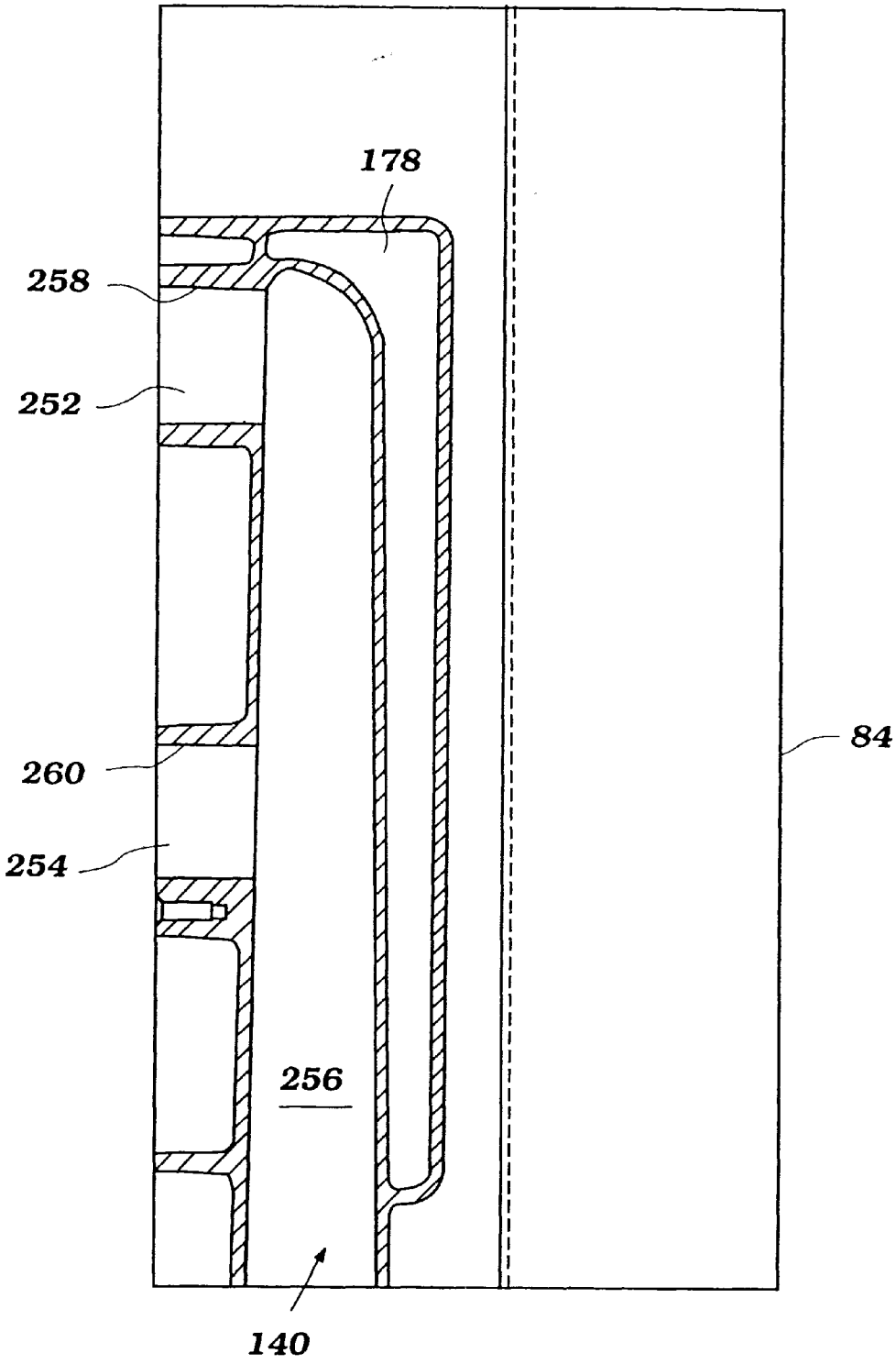
FIG. 11 is a sectional view of the cylinder block taken along the line 11—11 of FIG. 9.

The exhaust passages associated with the exhaust manifolds can be changed; however, the foregoing relationship of the cylinders and the firing order preferably is maintained. FIGS. 9–11 illustrate a further exhaust system arrangement configured in accordance with another preferred embodiment. The same components and members as those described already are assigned the same reference numerals and will not be described again.

Exhaust passages 300*a*, 300*d* corresponding to the exhaust passages 130*a*, 130*d* of the first embodiment are connected to an outer exhaust manifold 302, while exhaust passages 300*b*, 300*c* corresponding to the exhaust passages 130*b*, 130*c* of the first embodiment are connected to an inner exhaust manifold 304, which is located closer to the cylinder bank 88 than the outer exhaust manifold 302. Because of these connections, positions of the respective openings 252, 260, 282, 284 are slightly shifted so that a simpler arrangement can be provided.

Figure 12:
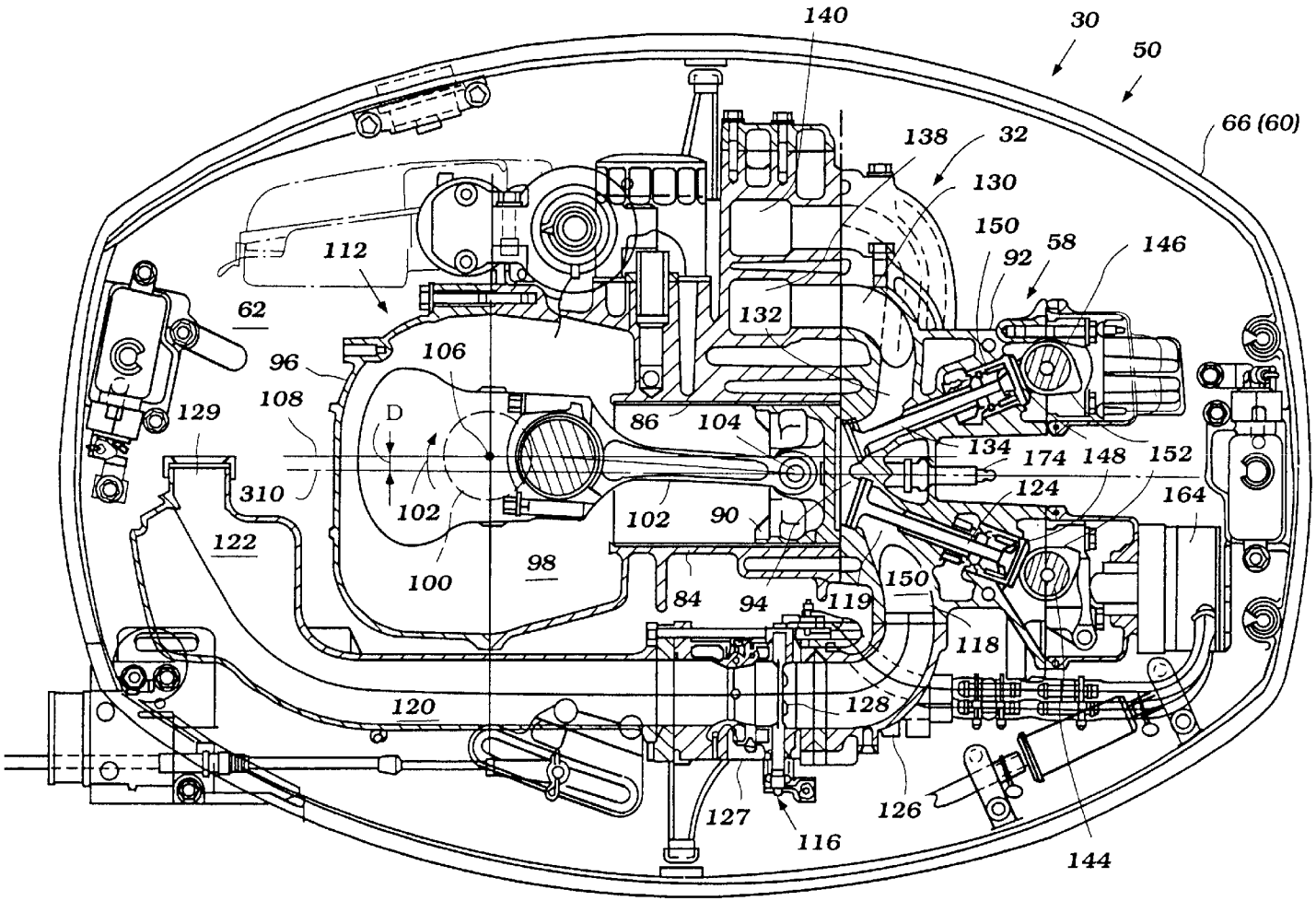
FIG. 12 is an enlarged top plan view of an outboard motor configured in accordance with a further embodiment of the present invention. A top cowling member is detached, and an engine of the outboard motor is shown in section similar to FIG. 2.

Due to having double exhaust manifolds along side the cylinder bank, the side on which the exhaust system is provided is likely to be bulkier and heavier than the side on which the induction system is provided. FIG. 12 illustrates another engine configuration in accordance with a preferred embodiment to lessen this misbalance. Again, the same components and members as those described already are assigned the same reference numerals and will not be described again.

A longitudinal center plane 310 of the cylinder bank 88 (which contains the cylinder bore axes and the piston pivot pin axes) in this embodiment is offset toward the side on which the induction system 116 is placed by a distance D. With this offset arrangement of the cylinder bores 86, the exhaust system 32 and the induction system 116 are also shifted in this direction. The distance D preferably is less than a diameter of a small end boss 312 of the connecting rod 102 at which a piston pin of the piston 90 is connected for pivotal movement. Preferably, however, the rotational axis 106 of the crankshaft 100 is positioned on the longitudinal center plane 108 of the protective cowling assembly 60. That is, the plane 310 including the pivotal axis 104 of the pistons 90 is offset from the plane 108 including the rotational axis 106 of the crankshaft 100.

The arrangement is advantageous because it provides not only a relatively broad space for the exhaust system 32 but also side thrusts of the pistons 90 can be reduced. The side thrust is a thrust made by the piston 90 against a sidewall 312 of the cylinder bore 86 during the power stroke due to the force vectors created due to the angular position of the corresponding connecting rod. A large side thrust produces a striking noise, often referred to as piston slap. This action also can increase wear of the pistons 90 and the side walls 312 of the cylinder bores 86, as well as can reduce engine performance. This side thrust of the piston can be reduced by the offset arrangement between the crankshaft axis and the cylinder axes.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. For example, while the present exhaust system has particular utility in an outboard motor, and thus has been described in this context, it also can be in other applications, including, but without limitations, inboard motors. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an internal combustion engine and a support member arranged to support the engine, the engine including a cylinder block defining a plurality of cylinder bores, the cylinder bores extending generally horizontally and spaced apart vertically from each other to form a cylinder bank, the cylinder block further defining first and second exhaust manifolds extending generally vertically along side the cylinder bank, the first exhaust manifold being interposed between the cylinder bank and the second exhaust manifold, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with one of the combustion chambers through at least one of the exhaust ports, at least one of the exhaust passages being connected to the first exhaust manifold, at least another one of the exhaust passages being connected to the second exhaust manifold, a top of the first exhaust manifold being positioned higher than a top of the second exhaust manifold.

2. The outboard motor as set forth in claim 1, wherein the cylinder bank has a generally vertical central plane and the first and second exhaust manifolds extend generally in parallel to the central plane.

3. The outboard motor as set forth in claim 1, wherein the first and second exhaust manifolds are configured so as to join together at a location lower than the lower-most cylinder bore.

4. The outboard motor as set forth in claim 3, wherein the first exhaust manifold includes a detour section communicating with one of the exhaust passages and with a downpipe section of the exhaust manifold.

5. The outboard motor as set forth in claim 4, wherein the exhaust passages and the first and second exhaust manifolds together define a plurality of exhaust paths, each one of the exhaust paths extends from one of the exhaust passages to a location where the first and second exhaust manifolds merge together, and the exhaust passages and the first and second exhaust manifolds are configured such that the lengths of the plurality of exhaust paths are generally equal to one another.

6. The outboard motor as set forth in claim 1, wherein the engine additionally includes an ignition system configured to fire the respective combustion chambers in a preset order, and the exhaust passages associated with the combustion chambers which have consecutive firing orders are arranged to communicate with different ones of the first and second exhaust manifolds.

7. The outboard motor as set forth in claim 1, wherein the engine additionally includes exhaust valves arranged to selectively open and close the exhaust ports.

8. The outboard motor as set forth in claim 7, wherein the exhaust passages associated with the exhaust valves, which do not open consecutively, are allotted to the same exhaust manifold.

9. The outboard motor as set forth in claim 1, wherein the cylinder bores and the first and second exhaust manifolds have end openings facing in the same direction, and the cylinder head is coupled with the cylinder block in a manner cooperating with the end openings.

10. The outboard motor as set forth in claim 1, wherein at least two exhaust passages are connected to the first exhaust manifold, each one of the at least two exhaust passages is generally equal in length to one another.

11. The outboard motor as set forth in claim 10, wherein at least other two exhaust passages are connected to the second exhaust manifold, each one of the at least other two exhaust passages is generally equal in length to one another.

12. An outboard motor comprising an internal combustion engine and a support member arranged to support the engine, the engine including a cylinder block defining a plurality of cylinder bores, the cylinder bores extending generally horizontally and spaced apart vertically from each other to form a cylinder bank, the cylinder block further defining at least two exhaust manifolds extending generally vertically along side the cylinder bank, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, at least one of the exhaust passages being connected to the exhaust manifolds so that at least one of the exhaust passages is allotted to each one of the exhaust manifolds, and a crankshaft coupled to the pistons and journaled for rotation about a crankshaft axis, the cylinder bank and the crankshaft being arranged such that a first plane, which contains the crankshaft axis, lies parallel to and offset from a second plane, which contains axes of the cylinder bores, the first plane being offset to a side of the second plane on which the exhaust manifolds are disposed.

13. An outboard motor comprising an internal combustion engine and a support member arranged to support the engine, the engine including a cylinder block defining a plurality of cylinder bores, first and second exhaust manifolds extending next to the cylinder bores, the first exhaust manifold being interposed between the cylinder bores and the second exhaust manifold, the first exhaust manifold being longer than the second exhaust manifold, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, at least one of the exhaust passages communicating with the first exhaust manifold, at least another one of the exhaust passages communicating with the second exhaust manifold, and the first exhaust manifold including a manifold section and a detour section that lies between one of the exhaust passages and the manifold section.

14. The outboard motor as set forth in claim 13, wherein the exhaust passages and the first and second exhaust manifolds together define a plurality of exhaust paths, each exhaust path extends from a respective exhaust passage to a location where the first and second exhaust manifolds merge together, and the exhaust passages and the first and second exhaust manifolds are configured such that the lengths of the plurality of exhaust paths are generally equal to one another.

15. The outboard motor as set forth in claim 13, wherein the engine additionaly includes an ignition system firing the respective combustion chambers in a preset order, and the exhaust passages associated with the combustion chambers which have consecutive firing orders communicate with different ones of the first and second exhaust manifolds.

16. The outboard motor as set forth in claim 13, wherein the cylinder bores and the first and second exhaust manifolds have end openings facing in the same direction, and the cylinder head is coupled with the cylinder block so as to cooperate with the end openings of the cylinder bores and the first and second exhaust manifolds.

17. An outboard motor comprising an internal combustion engine and a support member arranged to support the engine, the engine including a cylinder block defining a plurality of cylinder bores, the cylinder bores being disposed in line to form a cylinder bank, at least two exhaust manifolds, the respective exhaust manifolds extending along side the cylinder bank, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, the exhaust passages communicating with the exhaust manifolds so that at least one of the exhaust passages is connected to each one of the exhaust manifolds, at least one of the exhaust manifolds including a downpipe section and a detour section that lies between one of the exhaust passages and the downpipe section, and the exhaust manifold that includes the detour section being interposed between another one of the exhaust manifolds and the cylinder bank.

18. An outboard motor comprising an internal combustion engine and a support member arranged to support the engine, the engine including a cylinder block defining a plurality of cylinder bores, at least two exhaust manifolds, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, the exhaust passages communicating with the exhaust manifolds so that at least one of the exhaust passages is connected to each one of the exhaust manifolds, at least one of the exhaust manifolds including a downpipe section and a detour section that lies between one of the exhaust passages and the downpipe section, the detour section including a vertical jog.

19. An outboard motor comprising an internal combustion engine and a support member arranged to support the engine, the engine including a cylinder block defining a plurality of cylinder bores, at least two exhaust manifolds, pistons reciprocating within the cylinder bores, and a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, the exhaust passages communicating with the exhaust manifolds so that at least one of the exhaust passages is connected to each one of the exhaust manifolds, at least one of the exhaust manifolds including a downpipe section and a detour section that lies between one of the exhaust passages and the downpipe section, the detour section being defined at least in part by a baffle.

20. An outboard motor comprising an internal combustion engine and a support member arranged to support the engine, the engine including a cylinder block defining a plurality of cylinder bores, at least two exhaust manifolds, pistons reciprocating within the cylinder bores, a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, the exhaust passages communicating with the exhaust manifolds so that at least one of the exhaust passages is connected to each exhaust manifold, at least one of the exhaust manifolds including a downpipe section and a detour section that lies between one of the exhaust passages and the downpipe section, and a crankshaft coupled to the pistons and journaled for rotation about a crankshaft axis, the cylinder bores and the crankshaft being arranged such that a first plane, which contains the crankshaft axis, lies parallel to and offset from a second plane, which contains axes of the cylinder bores, the first plane being offset to a side of the second plane on which the exhaust manifolds are disposed.

21. An outboard motor comprising an internal combustion engine and a support member arranged to support the engine, the engine including a cylinder block defining a plurality of cylinder bores, the cylinder bores extending generally horizontally and spaced apart from each other to form a cylinder bank, the cylinder block further defining at least two exhaust manifolds, pistons reciprocating within the cylinder bores, a cylinder head closing ends of the cylinder bores to define combustion chambers together with the cylinder bores and the pistons, the cylinder head further defining a plurality of exhaust ports and a plurality of exhaust passages, each one of the combustion chambers having at least one of the exhaust ports, each one of the exhaust passages communicating with each one of the combustion chambers through at least one of the exhaust ports, the exhaust passages being connected to the exhaust manifolds so that at least one of the exhaust passages is allotted to each one of the exhaust manifolds, the exhaust manifolds being coupled together at a location lower than the lower-most cylinder bore, and a crankshaft coupled to the pistons and journaled for rotation about a crankshaft axis, the cylinder bores and the crankshaft being arranged such that a first plane, which contains the crankshaft axis, lies parallel to and offset from a second plane, which contains axes of the cylinder bores, the first plane being offset to a side of the second plane on which the exhaust manifolds are disposed.

22. The outboard motor as set forth in claim 21, wherein one of the exhaust manifolds is interposed between the cylinder bank and another one of the exhaust manifolds.

23. The outboard motor as set forth in claim 21, wherein the exhaust manifolds extend into the support member and join together within the support member.

24. The outboard motor as set forth in claim 21, wherein the engine additionally includes an ignition system firing the respective combustion chambers in a preset order, and the exhaust passages associated with the combustion chambers which have consecutive firing orders communicate with different ones of the exhaust manifolds.

25. The outboard motor as set forth in claim 21, wherein the cylinder bores and the exhaust manifolds have end openings facing in the same direction, and the cylinder head is coupled with the cylinder block in a manner cooperating with the end openings.

26. An outboard motor comprising an internal combustion engine and a support member arranged to support the engine, the engine including a cylinder block defining a plurality of cylinder bores disposed in line to form a cylinder bank, the cylinder block further defining at least two exhaust manifolds extending aside the cylinder bank, pistons reciprocating within the cylinder bores, a cylinder head closing ends of the cylinder bores to define combustion chambers together with the cylinder bores and the pistons, the cylinder head further defining a plurality of exhaust ports and a plurality of exhaust passages, each combustion chamber having at least one exhaust port, and each exhaust passage communicating with a respective one of the combustion chambers through at least one of the exhaust ports, the exhaust passages communicating with the exhaust manifolds so that at least one of the exhaust passages is connected to each exhaust manifold, and a crankshaft coupled to the pistons and journaled for rotation about a crankshaft axis, and the cylinder bores and the crankshaft being arranged such that a first plane, which contains the crankshaft axis, lies parallel to and offset from a second plane, which contains axes of the cylinder bores, the first plane being offset to a side of the second plane on which the exhaust manifolds are disposed.

27. The outboard motor as set forth in claim 26 additionally comprising a protective cowling arranged to surround the engine, the protective cowling having a longitudinal center plane extending vertically, wherein the first plane and the longitudinal center plane are generally coplanar, and the second plane is offset from the longitudinal center plane.

28. The outboard motor as set forth in claim 26, wherein the engine additionally includes an ignition system firing the respective combustion chambers in a preset order, and the exhaust passages associated with the combustion chambers which have consecutive firing orders communicate with different ones of the exhaust manifolds.

29. The outboard motor as set forth in claim 26, wherein the cylinder bores and the exhaust manifolds have end openings facing in the same direction, and the cylinder head is coupled with the cylinder block in a manner cooperating with the end openings.

30. An outboard motor comprising an internal combustion engine and a support member arranged to support the engine, the engine including a cylinder block defining a plurality of cylinder bores and first and second exhaust manifolds extending next to the cylinder bores, the first exhaust manifold being interposed between the cylinder bores and the second exhaust manifold, the first exhaust manifold being longer than the second exhaust manifold, the cylinder bores and the first and second exhaust manifolds having end openings facing generally in the same direction, pistons reciprocating within the cylinder bores, and a cylinder head closing the end openings of the cylinder bores to define combustion chambers together with the cylinder bores and the pistons, the cylinder head further defining at least one exhaust port per combustion chambers and exhaust passages communicating with the exhaust ports, the exhaust passages being coupled with the first and second exhaust manifolds at the end openings of the first and second exhaust manifolds so that at least one of the exhaust passages is allotted to each one of the first and second exhaust manifolds.

31. The outboard motor as set forth in claim 30, wherein the end openings of the first and second exhaust manifolds are located generally on the same plane.

32. The outboard motor as set forth in claim 30, wherein the engine additionally includes an ignition system firing the respective combustion chambers in a preset order, and the exhaust passages associated with the combustion chambers which have consecutive firing orders communicate with different ones of the first and second exhaust manifolds.

33. An outboard motor comprising an internal combustion engine and a support member arranged to support the engine, the engine including an engine body defining a plurality of cylinder bores in which pistons reciprocate, the cylinder bores extending generally horizontally and spaced apart vertically from each other to form a cylinder bank extending generally vertically, the engine body further defining first and second exhaust manifolds, the first exhaust manifold being interposed between the second exhaust manifold and the cylinder bank, a top of the first exhaust manifold being positioned higher than a top of the second exhaust manifold, the engine body additionally defining exhaust passages communicating with the cylinder bores, and at least one of the exhaust passages being coupled with the first exhaust manifold, at least another one of the exhaust passages being coupled with the second exhaust manifold.

34. An outboard motor comprising an internal combustion engine and a support member arranged to support the engine, the engine including an engine body defining a plurality of cylinder bores, the cylinder bores disposed in line to form a cylinder bank, the engine body further defining at least two exhaust manifolds extending aside the cylinder bank, the engine body additionally defining exhaust passages communicating with the cylinder bores, the exhaust passages being coupled with the exhaust manifolds so that at least one of the exhaust passages is allotted to each one of the exhaust manifolds, pistons reciprocating within the cylinder bores, and a crankshaft coupled to the pistons and journaled for rotation about a crankshaft axis, and the cylinder bores and the crankshaft being arranged such that a first plane, which contains the crankshaft axis, lies parallel to and offset from a second plane, which contains axes of the cylinder bores, the first plane being offset to a side of the second plane on which the exhaust manifolds are disposed.

35. An outboard motor comprising an internal combustion engine and a support member arranged to support the engine, the engine including an engine body defining a plurality of cylinder bores in which pistons reciprocate, the. cylinder bores extending generally horizontally and spaced apart vertically from each other to form a cylinder bank extending generally vertically, the engine body further defining first and second exhaust manifolds extending aside the cylinder bank, the first exhaust manifold being interposed between the cylinder bank and the second exhaust manifold, a top of the first exhaust manifold being positioned higher than a top of the second exhaust manifold, the engine body additionally defining exhaust passages communicating with the cylinder bores, and at least one of the exhaust passages being coupled with the first exhaust manifold, at least another one of the exhaust passages being coupled with the second exhaust manifold, the first exhaust manifold including a downpipe section and a detour section that lies between one of the exhaust passages and the downpipe section.

* * * * *